US007578920B2

(12) United States Patent
Noji et al.

(10) Patent No.: US 7,578,920 B2
(45) Date of Patent: Aug. 25, 2009

(54) ELECTROLYTIC PROCESSING METHOD

(75) Inventors: Ikutaro Noji, Tokyo (JP); Hozumi Yasuda, Tokyo (JP); Takeshi Iizumi, Tokyo (JP); Kazuto Hirokawa, Tokyo (JP); Itsuki Kobata, Tokyo (JP)

(73) Assignee: Ebara Corporation, Tokyo (JP)

( * ) Notice: Subject to any disclaimer, the term of this patent is extended or adjusted under 35 U.S.C. 154(b) by 933 days.

(21) Appl. No.: 10/948,320

(22) Filed: Sep. 24, 2004

(65) Prior Publication Data

US 2005/0067289 A1 Mar. 31, 2005

(30) Foreign Application Priority Data

Sep. 26, 2003 (JP) ..... 2003-336327

(51) Int. Cl.
*C25D 21/12* (2006.01)
*C25F 3/02* (2006.01)

(52) U.S. Cl. ..... 205/81; 205/84; 205/147; 205/641; 205/645

(58) Field of Classification Search ..... 205/81, 205/84, 641, 645, 147
See application file for complete search history.

(56) References Cited

U.S. PATENT DOCUMENTS 5,911,619 A 6/1999 Uzoh et al.
7,022,216 B2 * 4/2006 Taylor et al. ..... 205/658
2001/0035354 A1 * 11/2001 Ashjaee et al. ..... 205/103
2002/0047705 A1 * 4/2002 Tada et al. ..... 324/230

FOREIGN PATENT DOCUMENTS

WO 03/098676 11/2003

* cited by examiner

*Primary Examiner*—Patrick Ryan
*Assistant Examiner*—William T Leader
(74) *Attorney, Agent, or Firm*—Wenderoth, Lind & Ponack, L.L.P.

(57) ABSTRACT

An electrolytic processing apparatus can detect the end point of electrolytic processing stably with high precision and with a relatively simple construction. The electrolytic processing apparatus includes: a processing electrode which can come close to or into contact with a processing object; a feeding electrode for feeding electricity to the processing object; a fluid supply section for supplying fluid between the processing object and at least one of the processing electrode and the feeding electrode; a processing power source for applying a voltage between the processing electrode and the feeding electrode; a drive section for causing relative movement between the processing object and at least one of the processing electrode and the feeding electrode; and an eddy current sensor for detecting the thickness of the processing object from a change in eddy current loss. The sensor is disposed not in contact with (or separately) by an insulator from the processing electrode and/or the feeding electrode.

7 Claims, 18 Drawing Sheets

ELECTROLYTIC PROCESSING METHOD

BACKGROUND OF THE INVENTION

1. Field of the Invention

The present invention relates to an electrolytic processing apparatus and an electrolytic processing method, and more particularly to an electrolytic processing apparatus and an electrolytic processing method useful for processing a conductive material in a surface of a substrate, such as a semiconductor wafer, or for removing impurities adhering to a surface of a substrate.

2. Description of the Related Art

In recent years, instead of using aluminum or aluminum alloys as a material for forming circuits on a substrate such as a semiconductor wafer, there is an eminent movement towards using copper (Cu) which has a low electric resistivity and high electromigration resistance. Copper interconnects are generally formed by filling copper into fine recesses formed in the surface of a substrate. There are known various techniques for forming such copper interconnects, including chemical vapor deposition (CVD), sputtering, and plating. According to any such technique, a copper film is formed in the substantially entire surface of a substrate, followed by removal of unnecessary copper by chemical mechanical polishing (CMP).

FIGS. 1A through 1C illustrate, in sequence of process steps, an example of forming such a substrate W having copper interconnects. As shown in FIG. 1A, an insulating film 2, such as an oxide film of $SiO_2$ or a film of low-k material, is deposited on a conductive layer lain which semiconductor devices are formed, which is formed on a semiconductor base 1. Contact holes 3 and interconnect trenches 4 are formed in the insulating film 2 by the lithography/etching technique. Thereafter, a barrier layer 5 of TaN or the like is formed on the surface, and a seed layer 7 as an electric supply layer for electroplating is formed on the barrier layer 5.

Then, as shown in FIG. 1B, copper plating is performed onto the surface of the substrate W to fill the contact holes 3 and the trenches 4 with copper and, at the same time, deposit a copper film 6 on the insulating film 2. Thereafter, the copper film 6, the seed layer 7 and the barrier layer 5 on the insulating film 2 are removed by chemical mechanical polishing (CMP) so as to make the surface of the copper film 6 filled in the contact holes 3 and the interconnect trenches 4, and the surface of the insulating film 2 lie substantially on the same plane. Interconnects composed of the copper film 6 as shown in FIG. 1C are thus formed.

Components in various types of equipments have recently become finer and have required higher accuracy. As submicron manufacturing technology is becoming common, the properties of materials are more and more influenced by the processing method. Under these circumstances, with a conventional mechanical processing method in which a processing object in a workpiece is physically destroyed and removed from the workpiece by a tool, many defects may be produced, deteriorating the properties of the workpiece. Thus, it is increasingly important to perform processing without deteriorating the properties of the materials.

Some processing methods, such as chemical polishing, electrolytic processing, and electrolytic polishing, have been developed in order to solve this problem. In contrast with the conventional physical processing, these methods perform removal processing or the like through chemical dissolution reaction. Therefore, these methods do not suffer from defects, such as formation of a damaged layer and dislocation, due to plastic deformation, so that processing can be performed without deteriorating the properties of the materials.

An electrolytic processing method that utilizes a catalytic activity of an ion exchanger and performs processing in ultrapure water has been developed. As shown in FIG. 2, an ion exchanger 12*a* mounted on a processing electrode 14 and an ion exchanger 12*b* mounted on a feeding electrode 16 are allowed to be close to or into contact with the surface of a workpiece 10. A voltage is applied from a power source 17 to between the processing electrode 14 and the feeding electrode 16 while a processing fluid 18, such as ultrapure water, is supplied from a fluid supply section 19 to between the processing electrode 14, feeding electrode 16 and the workpiece 10, thereby carrying out removal processing of the surface layer of the workpiece 10.

According to this electrolytic processing, water molecules 20 in the fluid 18, such as ultrapure water, are dissociated by the ion exchangers 12*a* and 12*b* into hydroxide ions 22 and hydrogen ions 24. The hydroxide ions 22 thus produced, for example, are carried, by the electric field between the workpiece 10 and the processing electrode 14 and by the flow of the fluid 18, to the surface of the workpiece 10 facing the processing electrode 14, whereby the density of the hydroxide ions 22 in the vicinity of the workpiece 10 is increased, and the hydroxide ions 22 are reacted with the atoms 10*a* of the workpiece 10. The reaction product 26 produced by reaction is dissolved in the fluid 18 such as ultrapure water, and removed from the workpiece 10 by the flow of the liquid 18 along the surface of the workpiece 10.

Since the processing principle of electrolytic processing is a chemical interaction between ions and a workpiece, removal processing of the workpiece is possible even when the workpiece is not in contact with an electrode as a processing tool. Thus, electrolytic processing, unlike mechanical processing, has the advantage of not causing physical damage to a workpiece. On the other hand, however, since removal processing proceeds in a non-contact manner, it is generally difficult to control the processing so that the processing can be properly terminated at the end point of processing (herein refers to a point in time when a desired processing amount is reached). Especially when electrolytically processing a workpiece, as typified by a semiconductor substrate, in which a plurality of materials (e.g. copper and a seed layer), having different electric conductivities, become exposed on the processing surface with the progress of processing, there occurs a rapid change in the processing rate due to a change in the area (processing area) between two different materials. This may result in overprocessing at the end point of processing.

In view of this, it may be considered to control the application of electric current or voltage in response to a change in the processing area between different materials so as to suppress overprocessing at the end point of processing. Such a method, however, will necessitate fairly complicated control of the application of electric current or voltage.

SUMMARY OF THE INVENTION

The present invention has been made in view of the above situation in the related art. It is therefore an object of the present invention to provide an electrolytic processing apparatus and an electrolytic processing method which can detect the end point of electrolytic processing stably with high precision and with a relatively simple construction.

In order to achieve the above object, the present invention provides an electrolytic processing apparatus comprising: a processing electrode which can come close to or into contact with a processing object; a feeding electrode for feeding electricity to the processing object; a fluid supply section for supplying ultrapure water, pure water, a liquid having an electric conductivity of not more than 500 μS/cm or an electrolytic solution between the processing object and at least one of the processing electrode and the feeding electrode; a processing power source for applying a voltage between the processing electrode and the feeding electrode; a drive section for causing relative movement between the processing object and at least one of the processing electrode and the feeding electrode; and an eddy current sensor for detecting the thickness of the processing object from a change in eddy current loss. The sensor is disposed not in contact with (or separately) by an insulator from the processing electrode and/or the feeding electrode.

According to this electrolytic processing apparatus, the eddy current sensor is disposed not in contact with (or separately) by an insulator from the processing electrode and/or the feeding electrode so as to prevent a short circuit. The eddy current sensor can detect the thickness of a processing object in situ during processing based on a change in eddy current loss. This makes it possible to detect the end point of electrolytic processing stably with high precision and with a relatively simple construction.

In the case where the processing electrode and the feeding electrode are disposed close to each other, for example, provision of the eddy current sensor within the processing electrode will make the sensor portion of the processing electrode not capable of processing. Such a drawback can be avoided by providing the eddy current sensor within the feeding electrode. Further, by disposing an insulator between the feeding electrode and the eddy current sensor, the magnetic field of the eddy current sensor can be prevented from being influenced by the feeding electrode. The eddy current sensor may be provided in desired numbers.

The present invention also provides another electrolytic processing apparatus comprising: a processing electrode which can come close to or into contact with a processing object; a feeding electrode for feeding electricity to the processing object; a fluid supply section for supplying ultrapure water, pure water, a liquid having an electric conductivity of not more than 500 μS/cm or an electrolytic solution between the processing object and at least one of the processing electrode and the feeding electrode; a processing power source for applying a voltage or current, which is provided with an off time, between the processing electrode and the feeding electrode; a drive section for causing relative movement between the processing object and at least one of the processing electrode and the feeding electrode; and an eddy current sensor for detecting the thickness of the processing object from a change in eddy current loss when the voltage applied between the processing electrode and the feeding electrode with any inputting style is off. The sensor is disposed not in contact with (or separately) by an insulator from the processing electrode and/or the feeding electrode.

Electrolytic processing proceeds when a voltage is being applied between a processing electrode and a feeding electrode. Accordingly, when the thickness of a processing object is measured during application of a voltage between a processing electrode and a feeding electrode, the measured thickness can differ from the actual thickness. Further, when the thickness of a workpiece is measured with an eddy current sensor while carrying out electrolytic processing of the processing object by applying a pulse voltage between the processing electrode and the feeding electrode, noise is likely to be mixed into the detection signal of the eddy current sensor when the frequency of the pulse voltage applied comes close to the frequency (e.g. several tens of MHz) that the sensor generates for detection.

According to this electrolytic processing apparatus, the thickness of a processing object is measured with the eddy current sensor from a change in eddy current loss when the voltage applied between the processing electrode and the feeding electrode with any inputting style is off. This can reduce mixing of noise into the detection signal of the sensor due to the voltage applied between the processing electrode and the feeding electrode, enabling accurate control of the processing amount.

The voltage applied between the processing electrode and the feeding electrode is preferably a pulse voltage whose lowest potential periodically becomes 0.

The application of a pulse voltage between the processing electrode and the feeding electrode can effectively suppress the formation of pits in the processing surface of a workpiece. Further, by making the lowest potential of the pulse voltage 0, the thickness of a processing object can be detected at any time when the voltage is periodically 0 (off).

At least one eddy current sensor may be provided outside the processing electrode and the feeding electrode.

For example, if there is a space between the processing electrode and the feeding electrode where an eddy current sensor can be disposed without contact with the electrodes, the eddy current sensor may be disposed not in contact with the electrodes in the space. The eddy current sensor may be provided in desired numbers.

The eddy current sensor preferably comprises a sensor coil for generating an eddy current in the processing object, and an oscillation circuit, connected to the sensor coil, for generating a variable frequency signal in response to the eddy current loss, the sensor coil and the oscillation circuit being constructed integrally.

Such an eddy current sensor enables a low-impedance (50Ω) signal transmission, making it possible to operate the sensor stably without picking up the noise produced by the rotation of a processing table or the like. Further, when disposing the oscillation circuit (substrate) in a direction perpendicular to the sensor coil, it becomes possible to detect an eddy current loss using a high oscillation frequency in the VHF band.

Alternatively, the eddy current sensor may comprise a sensor coil disposed in the vicinity of the processing object, a signal source for supplying an alternating-current signal to the sensor coil so as to generate an eddy current in the processing object, and a detection circuit for detecting the eddy current generated in the processing object by means of the sensor coil.

According to this eddy current sensor, by observing a change in the resistance component when a conductive film is very thin while keeping an oscillation frequency fixed, it becomes possible to detect a change in the film thickness linearly with good sensitivity. Further, by observing a change in the reactance component when the conductive film is relatively thick, it becomes possible to detect a change in the film thickness linearly with good sensitivity. Furthermore, by observing a change in the impedance, comprising the resistance component and the reactance component, it becomes possible to detect a change in the film thickness of the conductive film, ranging from a very small thickness to a relatively large thickness, linearly with good sensitivity and with a wide dynamic range.

Thus, it becomes possible to detect an eddy current loss in a thin conductive film having a high resistivity. For example, the thickness of an angstrom-order thin film, such as a tantalum (Ta) film constituting a barrier layer, in electrolytic processing can be detected, enabling very accurate detection of the endpoint of processing.

Preferably, a ferromagnetic material is disposed around the sensor coil.

By disposing a ferromagnetic material around the sensor coil, the magnetic field represented by magnetic field lines can be reduced, which makes it possible to use a thinner insulator.

Preferably, a contact member is disposed between the processing object and at least one of the processing electrode and the feeding electrode.

The contact member is, for example, a member containing an electrolyte, an insulator or an electrically conductive pad, or a combination thereof. The member containing an electrolyte is composed of, for example, an ion exchanger or a material containing an ion-exchange substance.

By disposing an ion exchanger between the processing object and at least one of the processing electrode and the feeding electrode, the activation energy in the dissociation reaction of water molecule can be lowered through the interaction between a functional group in the ion exchanger and water molecules, whereby the dissociation of water can be promoted, leading to an increased processing rate.

The present invention provides an electrolytic processing method comprising: bringing a processing object close to or into contact with a processing electrode; supplying ultrapure water, pure water, a liquid having an electric conductivity of not more than 500 μS/cm or an electrolytic solution between the processing object and at least one of the processing electrode and a feeding electrode for feeding electricity to the processing object; applying a voltage between the processing electrode and the feeding electrode while moving the processing object and at least one of the processing electrode and the feeding electrode relative to each other; and detecting the thickness of the processing object from a change in eddy current loss by an eddy current sensor.

The present invention also provides another electrolytic processing method comprising: bringing a processing object close to or into contact with a processing electrode; supplying ultrapure water, pure water, a liquid having an electric conductivity of not more than 500 μS/cm or an electrolytic solution between the processing object and at least one of the processing electrode and a feeding electrode for feeding electricity to the processing object; applying a voltage or current, which is provided with an off time, between the processing electrode and the feeding electrode while moving the processing object and at least one of the processing electrode and the feeding electrode relative to each other; and detecting the thickness of the processing object from a change in eddy current loss by an eddy current sensor when the voltage applied between the processing electrode and the feeding electrode with any inputting style is off.

DETAILED DESCRIPTION OF THE PREFERRED EMBODIMENTS

Preferred embodiments of the present invention will now be described with reference to the drawings.

Figure 3:
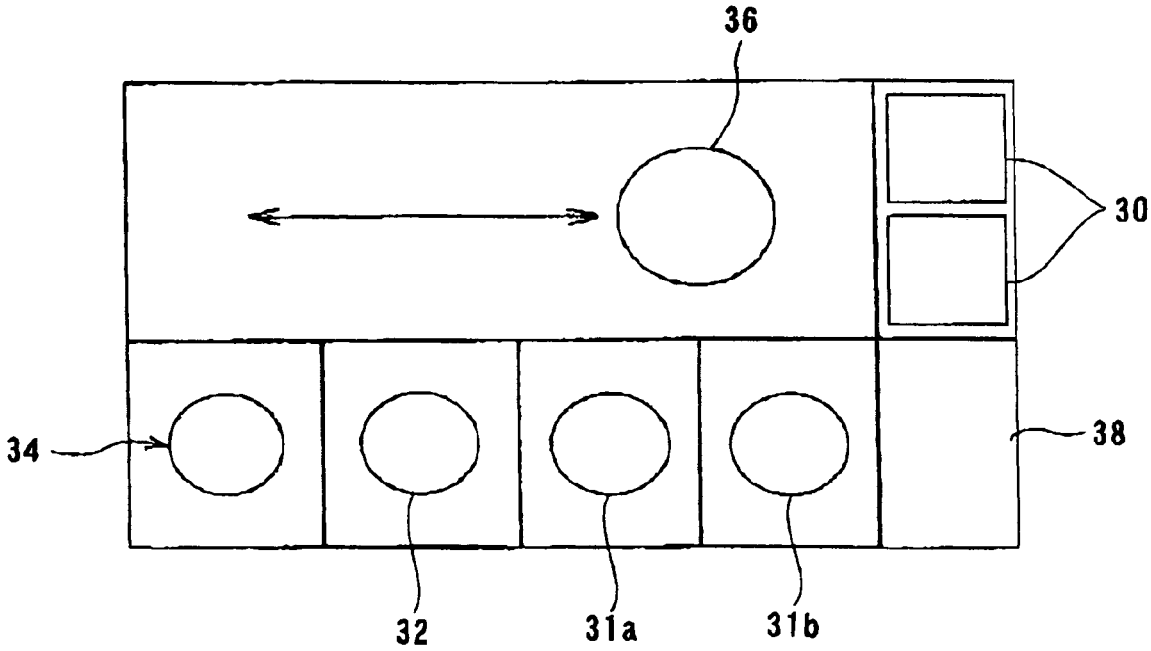
FIG. 3 is a plan view illustrating a substrate processing apparatus incorporated an electrolytic processing apparatus according to an embodiment of the present invention.

FIG. 3 is a plan view illustrating the construction of a substrate processing apparatus incorporating an electrolytic processing apparatus according to an embodiment of the present invention. According to the embodiment, a conductive film, such as a copper film or a barrier layer, formed in the surface of a substrate is processed (polished) by an electrolytic processing apparatus. The present invention is of course applicable to besides the substrate.

Figure 1A:
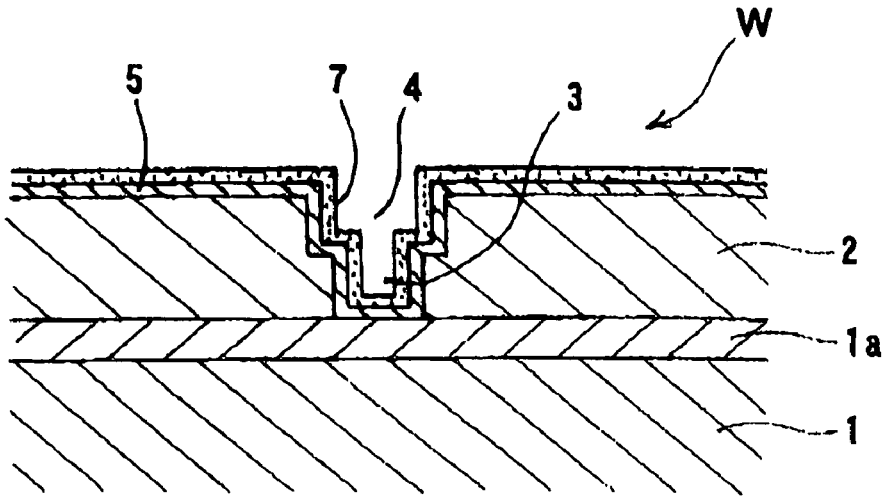
FIGS. 1A through 1C are diagrams illustrating, in sequence of process steps, an example of the formation of copper interconnects.
Figure 1B:
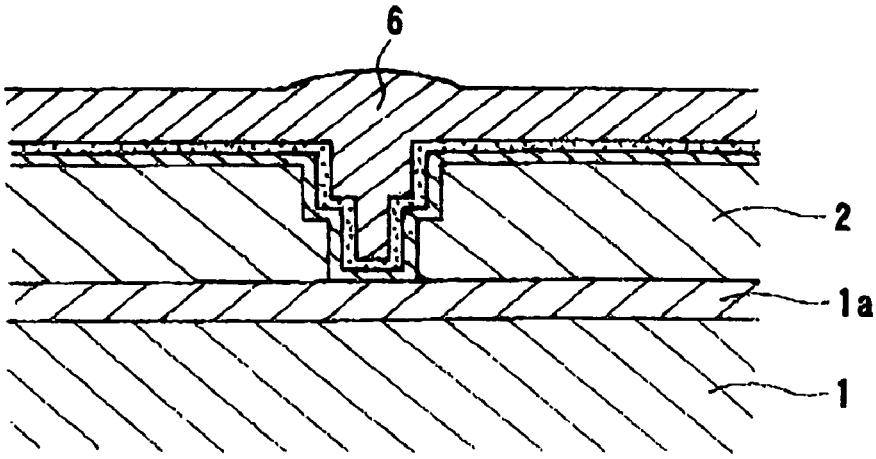
Figure 1C:
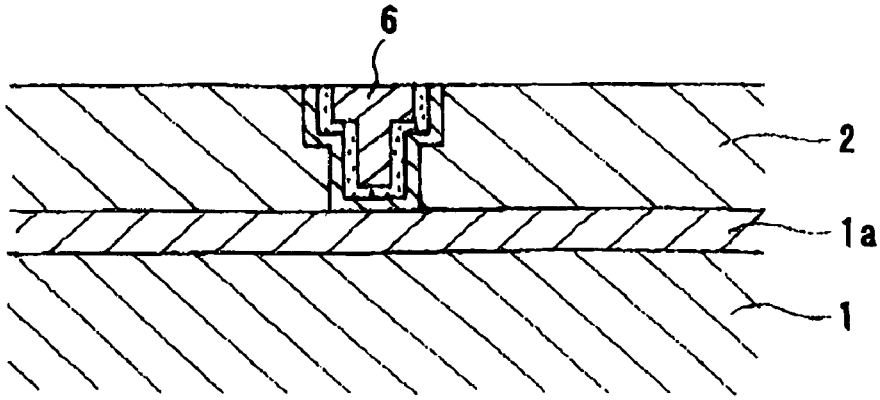
Figure 2:
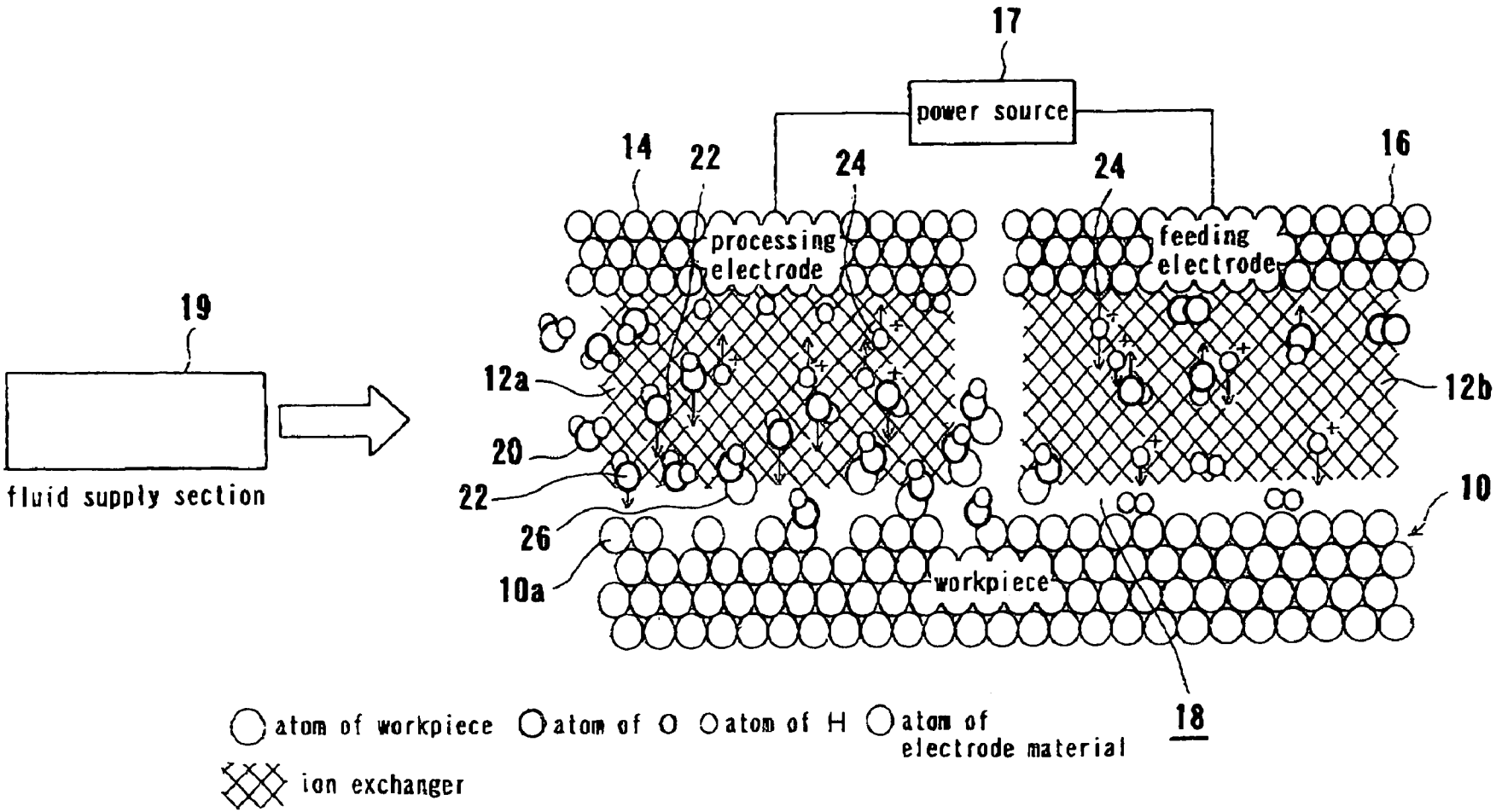
FIG. 2 is a diagram illustrating the principle of electrolytic processing employing an ion exchanger.

As shown in FIG. 3, the substrate processing apparatus comprises a pair of loading/unloading sections 30 as a carry-in/carry-out section for carrying in and out a substrate, e.g. a substrate W, as shown in FIG. 1B, which have a copper film 6 and a barrier layer 6 as conductive films (processing objects) in its surface, a first cleaning machine 31*a* for performing a primary cleaning of the substrate, a second cleaning machine 31*b* for performing a secondary cleaning (finish cleaning) of the substrate, a reversing machine 32 for reversing the substrate, and an electrolytic processing apparatus 34. These devices are disposed in series. A transport robot 36 as a transport device, which can move parallel to these devices for transporting and transferring the substrate W therebetween, is provided. The substrate processing apparatus is also provided with a control section 38, disposed adjacent to the loading/unloading units 30, for controlling the electrolytic processing apparatus 34 upon electrolytic processing in the electrolytic processing apparatus 34.

Figure 4:
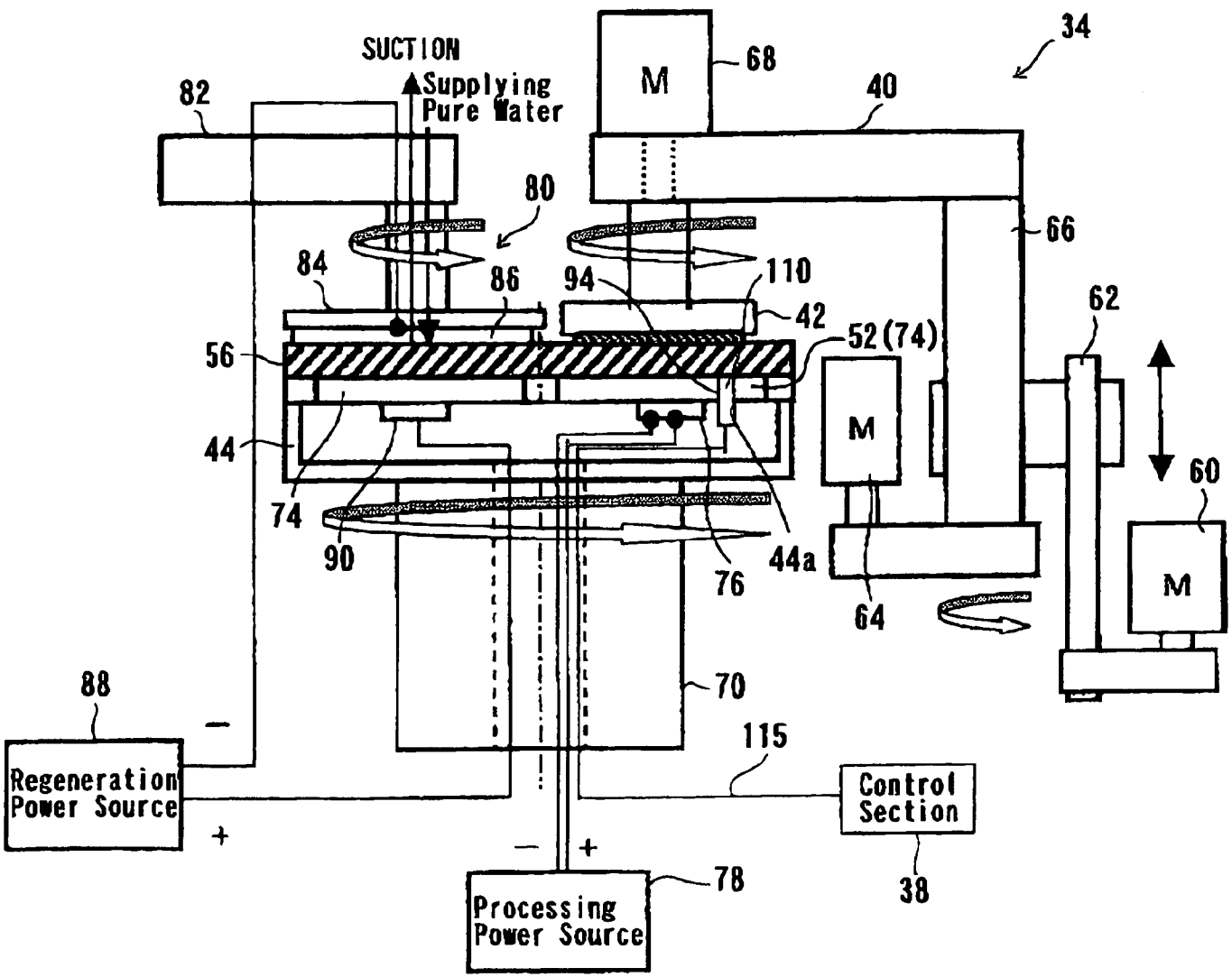
FIG. 4 is a vertical sectional view showing the electrolytic processing apparatus shown in FIG. 3.
Figure 5:
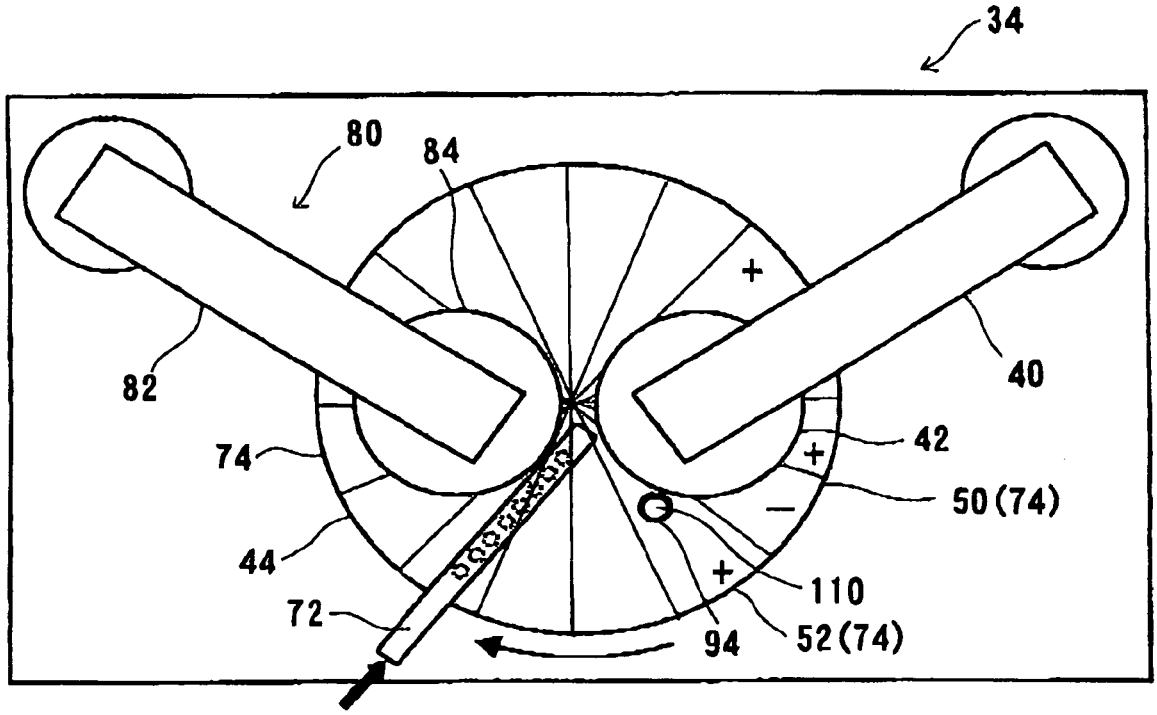
FIG. 5 is a plan view of the apparatus of FIG. 4.

FIG. 4 is a vertical sectional view of the electrolytic processing apparatus 34 shown in FIG. 3, and FIG. 5 is a plan view of the apparatus of FIG. 4. As shown in FIG. 4, the electrolytic processing apparatus 34 includes a pivot arm 40 that can pivot horizontally, a substrate holder 42, supported at the free end of the pivot arm 40, for attracting and holding the substrate W with its front surface facing downwardly (face-down), and a disc-shaped processing table 44 made of an insulating material. The processing table 44 is disposed below the substrate holder 42. As shown in FIG. 5, processing table 44 has, embedded therein, fan-shaped processing electrodes 50 and feeding electrodes 52 that are disposed alternately with their surfaces (upper faces) exposed. A film-like ion exchanger 56 is mounted on the upper surface of the processing table 44.

This embodiment uses, as an example of the processing table 44 having the processing electrodes 50 and the feeding electrodes 52, one that has a diameter more than twice that of the substrate W held by the substrate holder 42, so that the entire surface of the substrate W may undergo electrolytic processing.

The ion exchanger 56 may be composed of, for example, a non-woven fabric which has an anion-exchange group or a cation-exchange group. A cation exchanger preferably carries a strongly acidic cation-exchange group (sulfonic acid group); however, a cation exchanger carrying a weakly acidic cation-exchange group (carboxyl group) may also be used. Though an anion exchanger preferably carries a strongly basic anion-exchange group (quaternary ammonium group), an anion exchanger carrying a weakly basic anion-exchange group (tertiary or lower amino group) may also be used.

The non-woven fabric carrying a strongly basic anion-exchange group can be prepared by, for example, the following method: A polyolefin non-woven fabric having a fiber diameter of 20-50 μm and a porosity of about 90% is subjected to the so-called radiation graft polymerization, comprising γ-ray irradiation onto the non-woven fabric and the subsequent graft polymerization, thereby introducing graft chains; and the graft chains thus introduced are then aminated to introduce quaternary ammonium groups thereinto. The capacity of the ion-exchange groups introduced can be determined by the amount of the graft chains introduced. The graft polymerization may be conducted by the use of a monomer such as acrylic acid, styrene, glicidyl methacrylate, sodium styrenesulfonate or chloromethylstyrene, or the like. The amount of the graft chains can be controlled by adjusting the monomer concentration, the reaction temperature and the reaction time. Thus, the degree of grafting, i.e. the ratio of the weight of the non-woven fabric after graft polymerization to the weight of the non-woven fabric before graft polymerization, can be made 500% at its maximum. Consequently, the capacity of the ion-exchange groups introduced after graft polymerization can be made 5 meq/g at its maximum.

The non-woven fabric carrying a strongly acidic cation-exchange group can be prepared by the following method: As in the case of the non-woven fabric carrying a strongly basic anion-exchange group, a polyolefin non-woven fabric having a fiber diameter of 20-50 μm and a porosity of about 90% is subjected to the so-called radiation graft polymerization comprising γ-ray irradiation onto the non-woven fabric and the subsequent graft polymerization, thereby introducing graft chains; and the graft chains thus introduced are then treated with a heated sulfuric acid to introduce sulfonic acid groups thereinto. If the graft chains are treated with a heated phosphoric acid, phosphate groups can be introduced. The degree of grafting can reach 500% at its maximum, and the capacity of the ion-exchange groups thus introduced after graft polymerization can reach 5 meq/g at its maximum.

The base material of the ion exchanger 56 may be a polyolefin such as polyethylene or polypropylene, or any other organic polymer. Further, besides the form of a non-woven fabric, the ion exchanger may be in the form of a woven fabric, a sheet, a porous material, or short fibers, etc.

When polyethylene or polypropylene is used as the base material, graft polymerization can be effected by first irradiating radioactive rays (γ-rays and electron beam) onto the base material (pre-irradiation) to thereby generate a radical, and then reacting the radical with a monomer, whereby uniform graft chains with few impurities can be obtained. When an organic polymer other than polyolefin is used as the base material, on the other hand, radical polymerization can be effected by impregnating the base material with a monomer and irradiating radioactive rays (γ-rays, electron beam and UV-rays) onto the base material (simultaneous irradiation). Though this method fails to provide uniform graft chains, it is applicable to a wide variety of base materials.

By using a non-woven fabric having an anion-exchange group or a cation-exchange group as the ion exchanger 56, it becomes possible that pure water or ultrapure water, or a liquid such as an electrolytic solution can freely move within the non-woven fabric and easily arrive at the active points in the non-woven fabric having a catalytic activity for water dissociation, so that many water molecules are dissociated into hydrogen ions and hydroxide ions. Further, by the movement of pure water or ultrapure water, or a liquid such as an electrolytic solution, the hydroxide ions produced by the water dissociation can be efficiently carried to the surfaces of the processing electrodes 50, whereby a high electric current can be obtained even with a low voltage applied.

When the ion exchanger 56 has only one of anion-exchange groups and cation-exchange groups, a limitation is imposed on electrolytically processible materials and, in addition, impurities are likely to form due to the polarity. In order to solve this problem, the ion exchanger 56 may have such a structure that anion-exchanger having an anion-exchange group and cation-exchangers having a cation-exchange group are concentrically disposed to constitute an integral structure. The anion exchangers and the cation exchangers may be superimposed on the surface, to be processed, of a substrate. It may also be possible to make the anion-exchangers and the cation-exchangers each in the shape of a fan, and dispose them alternately. Alternatively, the above problem can be solved by using, as the ion exchanger 56, an ion-exchanger which in itself carries both of an anion-exchange group and a cation-exchange group.

Such an ion exchange may include an amphoteric ion exchanger in which anion-exchange groups and cation-exchange groups are distributed randomly, a bipolar ion exchanger in which cation-exchange groups and anion-exchange groups are present in layers, and a mosaic ion exchanger in which portions containing cation-exchange groups and portions containing anion-exchange groups are present in parallel in the thickness direction. It is, of course, possible to use an ion exchanger 56 having one of anion-exchange and cation-exchange groups for a particular to-be-processed material and use another exchanger 56 having the other type of ion-exchange group for another to-be-processed material.

The pivot arm 40, as shown in FIG. 4, is connected to the upper end of a pivot shaft 66 that moves up and down via a ball screw 62 by the actuation of a vertically-moving motor 60 and rotates by the actuation of a pivot motor 64. The substrate holder 42 is connected to a rotation motor 68 that is mounted on the free end of the pivot arm 40, and is allowed to rotate (about its axis) by the actuation of the rotation motor 68.

The processing table 44 is connected directly to a hollow motor 70, and is allowed to rotate (about its axis) by the actuation of the hollow motor 70. A through-hole (not shown) as a pure water supply section for supplying pure water, preferably ultrapure water, is formed in the central portion of the processing table 44. The through-hole is connected to a pure water supply pipe (not shown) that vertically extends inside the hollow motor 70. Pure water or ultrapure water is supplied through the through-hole, and via the ion exchanger 56 having water absorption properties, is supplied to the entire processing surface.

Further, a pure water nozzle 72, extending in the radial direction of the processing table 44 and having a plurality of supply ports for supplying pure water or ultrapure water, is disposed above the processing table 44, as shown in FIG. 5. Pure water or ultrapure water is thus supplied to the surface of the substrate W from above and beneath the substrate W simultaneously. Pure water herein refers to a water having an electric conductivity of not more than 10 μS/cm (1 atm, 25° C.), for example, and ultrapure water refers to a water having an electric conductivity of not more than 0.1 μS/cm, for example. Instead of pure water, a liquid having an electric conductivity of not more than 500 μS/cm or any electrolytic solution may be used. By supplying electrolytic solution during processing, the instability factors of processing, such as process products and gas bubbles, can be removed, and processing can be effected uniformly with good reproducibility.

According to this embodiment, as shown FIGS. 4 and 5, a plurality of fan-shaped electrode plates 74 are disposed in the processing table 44 in the circumference direction, and a cathode and an anode of a processing power source 78 are alternately connected, via a slip ring 76, to the electrode plates 74. The electrode plates 74 connected to the cathode of the processing power source 78 become the processing electrodes 50 and the electrode plates 74 connected to the anode of the processing power source 78 become the feeding electrodes 52. This applies to processing of e.g. copper, because electrolytic processing of copper proceeds on the cathode side. Depending upon a material to be processed, the cathode side can be a feeding electrode and the anode side can be a processing electrode. More specifically, when the material to be processed is copper, molybdenum, iron or the like, electrolytic processing proceeds on the cathode side, and therefore the electrode plates 74 connected to the cathode of the processing power source 78 should be the processing electrodes 50 and the electrode plates 74 connected to the anode should be the feeding electrodes 52. In the case of aluminum, silicon or the like, on the other hand, electrolytic processing proceeds on the anode side. Accordingly, the electrode plates connected to the anode of the power source should be the processing electrodes and the electrode plates connected to the cathode should be the feeding electrodes.

By thus disposing the processing electrodes 50 and the feeding electrodes 52 separately and alternately in the circumferential direction of the processing table 44, fixed feeding portions to supply electricity to a conductive film (processing object) of the substrate is not needed, and processing can be effected to the entire surface of the substrate. Furthermore, by changing the positive and negative of the voltage in a pulse form, it becomes possible to dissolve the electrolysis products, and improve the flatness of the processed surface through the multiplicity of repetition of processing.

With respect to the processing electrodes 50 and the feeding electrodes 52, oxidation or dissolution thereof due to an electrolytic reaction may be a problem. In view of this, as a material for the processing electrodes 50 and the feeding electrodes 52, it is possible to use, besides the conventional metals and metal compounds, carbon, relatively inactive noble metals, conductive oxides or conductive ceramics. A noble metal-based electrode may, for example, be one obtained by plating or coating platinum or iridium onto a titanium electrode, and then sintering the coated electrode at a high temperature to stabilize and strengthen the electrode. Ceramics products are generally obtained by heat-treating inorganic raw materials, and ceramics products having various properties are produced from various raw materials including oxides, carbides and nitrides of metals and nonmetals. Among them there are ceramics having an electric conductivity. When an electrode is oxidized, the value of the electric resistance generally increases to cause an increase of applied voltage. However, by protecting the surface of an electrode with a non-oxidative material such as platinum or with a conductive oxide such as an iridium oxide, the decrease of electric conductivity due to oxidation of the base material of an electrode can be prevented.

When electrolytic processing of copper is conducted by using, as the ion exchanger 56, for example, an ion exchanger having a cation-exchange group, the ion-exchange group of the ion exchanger (cation exchanger) 56 is saturated with copper after the processing, whereby the processing efficiency of the next processing is lowered. When electrolytic processing of copper is conducted by using, as the ion exchanger 56, an ion exchanger having an anion-exchange group, fine particles of a copper oxide can be produced and adhere to the surface of the ion exchanger (anion exchanger) 56, which particles can contaminate the surface of a next substrate to be processed.

In order to obviate such drawbacks, in this embodiment, a regeneration section 80 for regenerating the ion exchanger 56 is provided, and the regeneration of the ion exchanger 56 with the regeneration section 80 can be effected during electrolytic processing. The regeneration section 80 comprises a pivot arm 82 having a structure similar to the pivot arm 40 that holds the substrate holder 42 and positioned at the opposite side to the pivot arm 40 across the processing table 44, and a regeneration head 84 held by the pivot arm 82 at the free end thereof. A regeneration electrode 86 is attached to the lower surface of the regeneration head 84.

In operation, the reverse electric potential to that for processing is given to the ion exchanger 56 from a regeneration power source 88, that is, the regeneration electrode 86 is connected to a cathode of the regeneration power source 88 and the electrode plates 74 facing the regeneration electrode 86 are connected to an anode of the regeneration power source 88 via a slip ring 90, and a voltage is applied to between the regeneration electrode 88 and the electrode plates 74, thereby promoting dissolution of extraneous matter such as copper adhering to the ion exchanger 56 positioned between the regeneration electrode 88 and the electrode plates 74. The regeneration of the ion exchanger 56 during processing can thus be effected. The regenerated ion exchanger 56 is rinsed by pure water or ultrapure water that is supplied to between the regeneration electrode 86 and the processing table 48, and removed by the suction.

In the processing table 44, an eddy current sensor 110 for detecting the thickness of a processing object, such as a conductive film, from a change in eddy current loss to detect the end point of processing, is disposed such that it penetrates the electrode plate 74 serving as the feeding electrode 52. In particular, a recess 44*a*, penetrating the electrode plate 74 serving as the feeding electrode 52, is provided in the processing table 44, and the eddy current sensor 110 surrounded by an insulator 94 is housed in the recess 44*a*. A coaxial cable 115, extending from the eddy current sensor 110, is connected to the control section 38. The eddy current sensor 110 can continually detect the thickness (film thickness) of a processing object, such a conductive film, in situ during processing from a change in eddy current loss. The eddy current sensor 110 may be provided in desired numbers.

By thus arranging the eddy current sensor 110 so that it is not in contact with the feeding electrode 52, a short circuit between the eddy current sensor 110 and the feeding electrode 52 can be prevented. Further, by surrounding the eddy current sensor 110 with the insulator 94, the magnetic field of the eddy current sensor 110 can be prevented from being influenced by the feeding electrode 52. A ferromagnetic material is preferably used for the insulator 94. The use of a ferromagnetic material can reduce the magnetic field represented by magnetic field lines, making it possible to use a thinner insulator 94.

In the case where a processing electrode and a feeding electrode are disposed close to each other as in this embodiment, provision of an eddy current sensor within the processing electrode will make the sensor portion of the processing electrode not capable of processing. Such a drawback can be avoided by providing the eddy current sensor within the feeding electrode.

When a pulse current or an alternating current is applied between the processing electrodes 50 and the feeding electrodes 52, an alternating current is generated also in a processing object (conductive film), such as a copper film, as described below. The frequency of the pulse or alternating current applied is of the order of several KHz, while the frequency of an electric current which is applied to the eddy current sensor is of the order of several MHz. Accordingly, upon detection by the sensor, the influence of the pulse or alternating current can be dealt with as an error.

Figure 6:
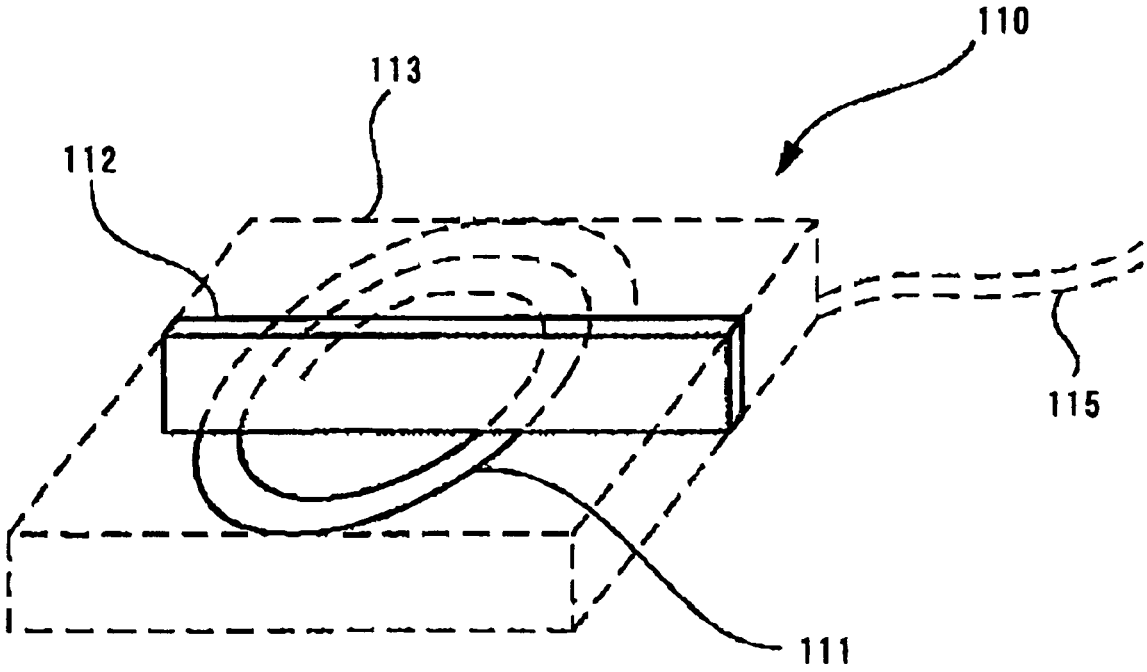
FIG. 6 is a perspective view schematically showing the construction of an eddy current sensor.

FIG. 6 schematically shows the construction of the eddy current sensor 110. The eddy current sensor 110 comprises a sensor coil 111 for generating an eddy current in a conductive film, and an oscillation circuit (substrate) 112, connected to the sensor coil 111, for generating a variable frequency signal in response to an eddy current loss, the sensor coil 111 and the oscillation circuit 112 being constructed integrally. The sensor coil 111 and the oscillation circuit 112 are housed in a box 113. The size of the box 113 is, for example, 20 mm square or less and 10 mm height or less. A coaxial cable 115 with an impedance of about 50Ω is connected to the oscillation circuit 112, so that a direct current is supplied to the eddy current sensor 110. The coaxial cable 115 functions as an output cable for outputting an oscillation signal.

The sensor coil 111 has an air-core vortical shape and, for example, about two turns. The oscillation circuit 112 is disposed at a right angle to the air-core vortical sensor coil 111, so that the sensor coil 111 will not generate an eddy current in a conductive material on the oscillation circuit (substrate) 112. In this regard, if the oscillation circuit 112 is disposed parallel to the sensor coil 111, the magnetic flux generated by the sensor coil 111 will generate an eddy current in a conductive material on the circuit substrate, and the eddy current sensor 110 will detect a loss of that eddy current, which would lower the detection accuracy of the sensor. The generation of eddy current in a conductive material on the substrate is also undesirable for the operation of the oscillation circuit (substrate) 112. By disposing the sensor coil 111 and the oscillation circuit (substrate) 112 at right angles to each other, it becomes possible to detect an eddy current loss with high precision at a high oscillation frequency, for example, about 200 MHz, as will be described later.

An oscillation circuit of the Colpitts type, for example, is employed as the oscillation circuit 112. A tank circuit is formed by the inductance of the sensor coil 111 and the capacitance of the condenser of the oscillation circuit 112, and the oscillation frequency of the oscillation circuit 112 is determined by the oscillation frequency of the tank circuit. The reactance component of the equivalent impedance of the sensor coil changes in response to eddy current loss, whereby the oscillation frequency changes.

According to this embodiment, the oscillation frequency is set at about 200 MHz, which lies in the VHF band, by selecting the inductance value of the sensor coil 111 and the capacitance value of the condenser of the oscillation circuit 112. The selection of such oscillation frequency makes it possible to obtain a detection sensitivity which meets the resistivity of conductive film that produces an eddy current loss. In this regard, typical examples of the conductive film as an object of electrolytic processing include a barrier layer of tantalum (Ta) and a copper film formed on the barrier layer. The resistivity of tantalum (Ta) is about 160 Ωm, while the resistivity of copper (Cu) is about 1.6 Ωm, i.e. about 1/100 of that of Ta.

Figure 7A:
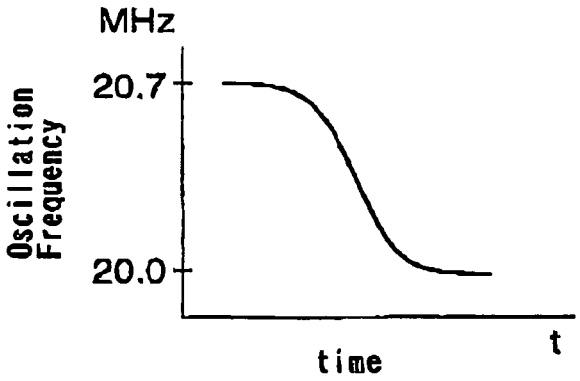
FIGS. 7A and 7B are graphs each showing a change in the oscillation frequency of the eddy current sensor shown in FIG. 6 with the process of electrolytic processing.

In the case where the conductive film is copper (Cu), good detection precision can be obtained at an oscillation frequency of about 20 MHz, as shown in FIG. 7A. In particular, when the film thickness of copper (Cu) is sufficiently large, the oscillation frequency is about 20.7 MHz, while the oscillation frequency is about 20.0 MHz when the film of copper (Cu) is almost removed. A satisfactory detection width of about 0.7 MHz, i.e. the difference in oscillation frequency before and after removal of the copper film, can thus be obtained.

Figure 7B:
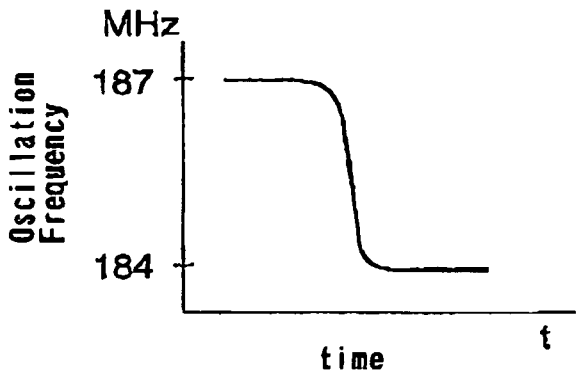

On the other hand, in the case of a tantalum (Ta) film used as a barrier layer, the oscillation frequency is about 187 MHz when the film thickness of the tantalum (Ta) film is sufficiently large, while the oscillation frequency is about 184 MHz when the film thickness of the tantalum (Ta) film becomes nearly 0 (zero), as shown in FIG. 7B. Also in this case, a satisfactory detection width of about 3 MHz can be obtained.

The film thickness of the tantalum (Ta) film as a barrier layer is of an angstrom order, and the film thickness of the copper (Cu) film is of a μm order. The eddy current sensor 110 makes it possible to detect the progress of electrolytic processing for the very thin tantalum (Ta) film constituting a barrier layer. In this connection, when detecting the copper film with an oscillation frequency of 7 MHz, an error of e.g. about 1000 Å may be produced at the end point of electrolytic processing. On the other hand, by detecting the very thin tantalum (Ta) layer with an oscillation frequency of about 180 MHz, detection of the end point of processing for the barrier layer having an angstrom-order thickness becomes possible. Thus, the detection precision in the detection of the end point of electrolytic processing can be remarkably enhanced.

Figure 8:
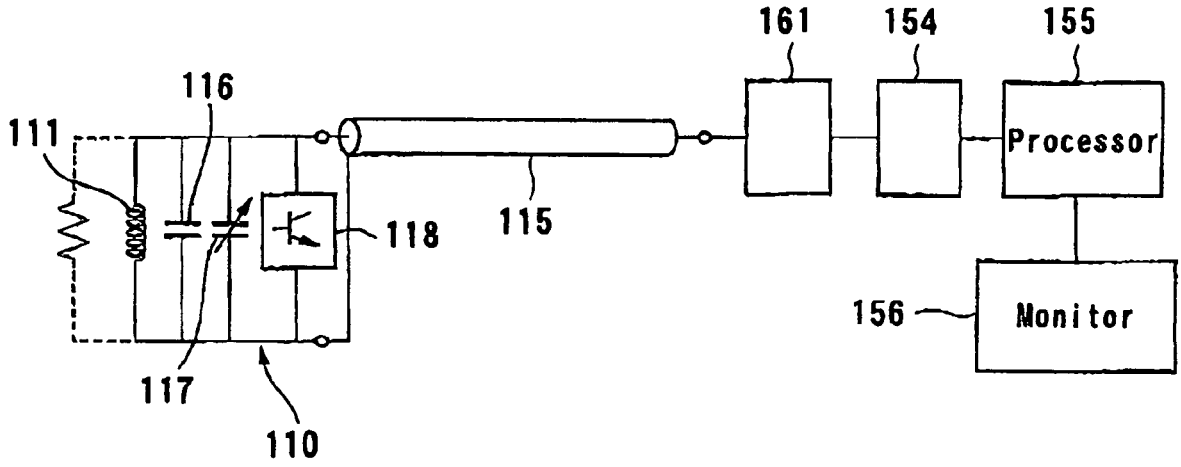
FIG. 8 is a diagram showing a detection circuit for detection of the oscillation signal of the eddy current sensor.

FIG. 8 shows a detection circuit for detecting an eddy current loss with the eddy current sensor 110. The eddy current sensor 110 is comprised of the sensor coil 111, condensers 116, 117 which, together with the sensor coil 111, form a tank circuit, and an active circuit element 118 of such as a transistor or the like. The capacitance is comprised of a fixed capacitor (condenser) 116 and a variable capacitor (condenser) 117. The variable capacitor 117 constitutes an automatic frequency tuning circuit, as will be described later. A divider or subtracter 161 and a distribution board 154 for waveform conversion are connected via the coaxial cable 115 to the eddy current sensor 110.

The coaxial cable 115 is used both as a feeding cable from a power source and as a signal cable, as described above. The eddy current sensor 110 is connected via a coupling condenser to an oscillation signal detection section, and a direct current is supplied from the interface board side. The divider is to alter the oscillation frequency detected. Of the fixed portion and the changed portion of the detected frequency, most of the fixed portion is subtracted by the subtracter, whereby the dissolution can be enhanced.

The oscillation signal detection section in a processor 155 is to detect the progress of electrolytic processing from a change in eddy current loss with the progress of electrolytic processing, and the following two methods are generally employed for the detection. The first method is to detect a change in the oscillation frequency of the oscillation signal. As shown in FIGS. 7A and 7B, an eddy current loss changes with the progress of electrolytic processing of a conductive film, and the equivalent resistance of the sensor coil changes. Accordingly, the oscillation frequency of the oscillation circuit changes. By dividing or subtracting the oscillation signal by the divider or the subtracter, the signal corresponding to a frequency within the detection width can be displayed on a monitor, thus obtaining a graph showing a change in the oscillation frequency, such as those shown in FIGS. 7A and 7B.

When a conductive film being processed is sufficiently thick, a change in eddy current loss with the progress (elapse of time t) of electrolytic processing is small, and therefore a change in the oscillation frequency is also small. As the conductive film becomes thin with the progress of electrolytic processing, the eddy current loss decreases rapidly and therefore the oscillation frequency also decreases rapidly. After the conductive film is completely removed, the oscillation frequency becomes substantially constant, though processing of the underlying insulating film (oxide film) may proceed because the conductive layer per se does not exist. Thus, the turning point from the rapid decrease to constancy in the oscillation frequency can be regarded as the end point of electrolytic processing. By performing moving average processing and differential processing of the output of the eddy current sensor 110, and observing the results of the differential processing, it becomes possible to detect the end point of electrolytic processing with high precision.

It is also possible to alter the manner of carrying out electrolytic processing when the eddy current sensor 110 detects a certain thinness of the conductive film. In particular, when the eddy current sensor 110 detects a predetermined thickness of the conductive film, the signal is transmitted from the eddy current sensor 110 to the control section 38, and the control section 38 alters the operating conditions of electrolytic processing. As compared to the processing conditions (first processing conditions) employed in the period from the beginning to the detection of the predetermined film thickness, the second processing conditions may be altered by (1) shortening the contact time between the substrate and the processing electrodes, (2) lowering the voltage applied between the feeding electrodes and the processing electrodes and/or (3) lowering the electric conductivity of the processing liquid used.

The oscillation frequency detected by the oscillation signal detection section is transmitted to the control circuit, and a deviation in the oscillation frequency can be corrected automatically by automatic frequency tuning by changing the capacitance value of the variable condenser (varicap) 117, whereby a variation in the self-oscillation frequency of the sensor can be suppressed. This caneliminate individual differences between sensors, can stabilize the sensitivity of the output signal frequency of the eddy current sensor 110, and can eliminate variations between sensors due to their production accuracy.

Figure 9:
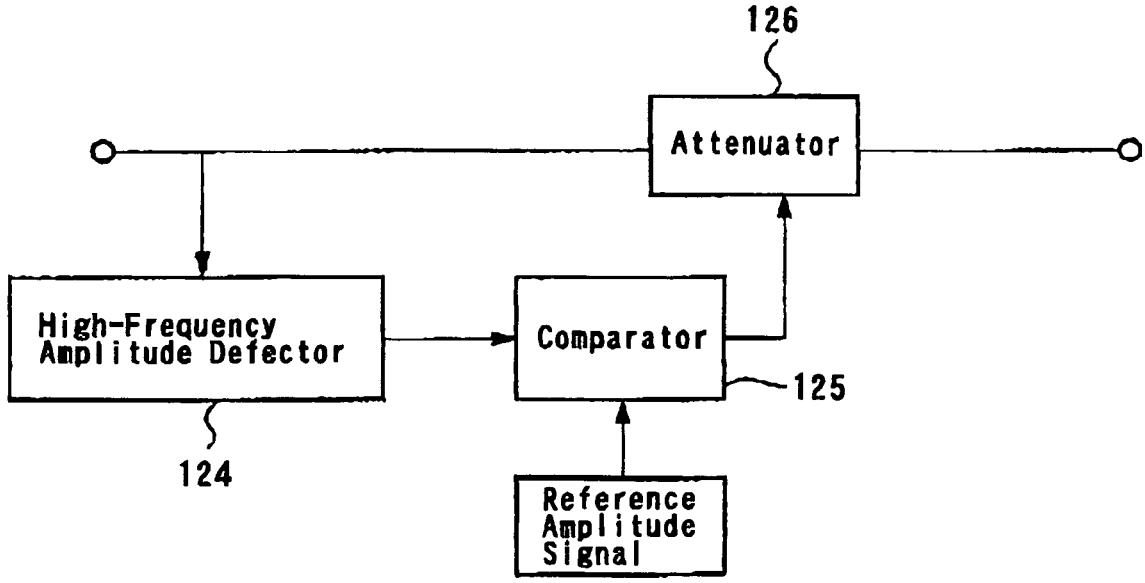
FIG. 9 is a diagram showing an amplitude modulation circuit for use in the detection circuit of FIG. 8.

When an automatic level control (ALC) method is employed to stabilize the oscillation frequency of the oscillation circuit so as to make the amplitude constant, a high-frequency amplitude detector 124 is provided in the oscillation signal detection section, as shown in FIG. 9. The intensity of the detected signal is compared with a reference amplitude signal by a comparator 125 and, based on the results, an attenuator 126 is operated whereby the amplitude can be controlled at a constant value. By introducing such a circuit, it becomes possible to stabilize the operation upon conversion from the high-frequency signal of the eddy current sensor into a TTL-level signal and to stabilize the S/N ratio.

Figure 10A:
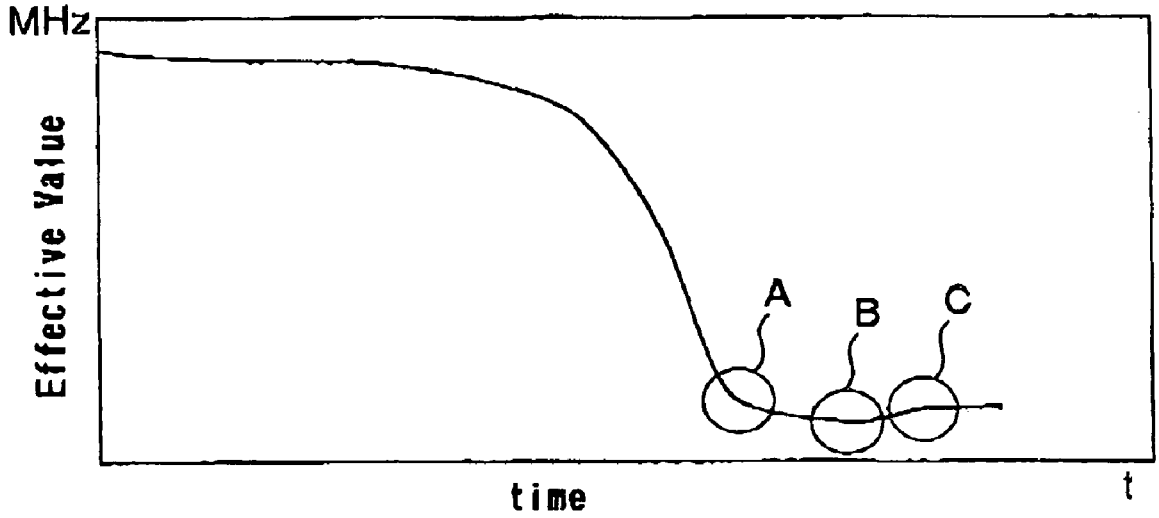
FIG. 10A is a graph showing a change in the oscillation frequency of the eddy current sensor.
Figure 10B:
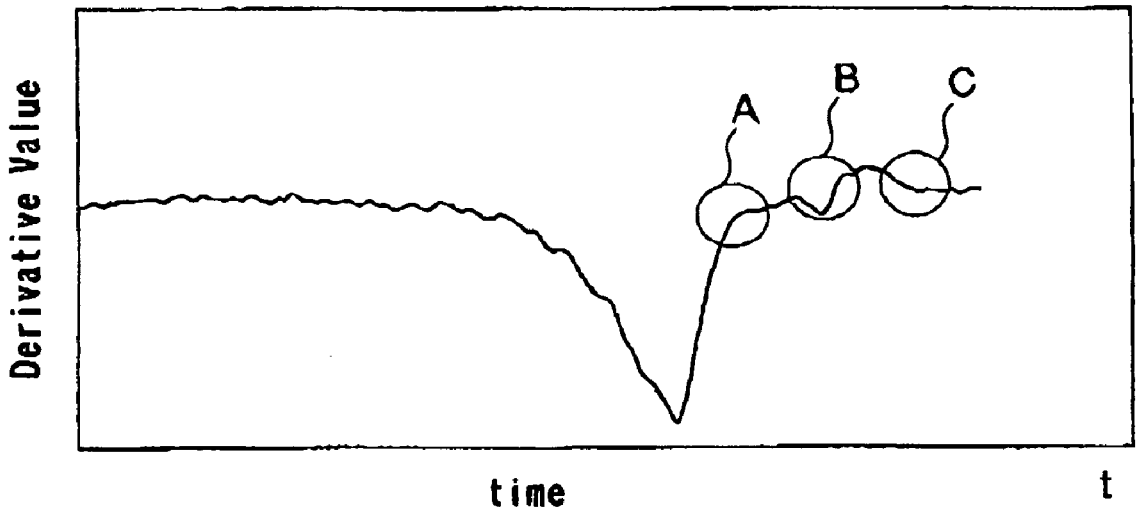
FIG. 10B is a graph showing a change in the time derivative value of the oscillation frequency.

It is possible to consider a time-gradient change of the frequency in the oscillation frequency signal of the eddy current sensor 110. Thus, the time derivative signal of the oscillation frequency is calculated, and determination of the end point of electrolytic processing can be made by a characteristic point on the time derivative curve obtained. FIG. 10A shows a change in the oscillation frequency as a function of time t, and FIG. 10B shows a change in the derivative value of the oscillation frequency of time t. In these Figures, A indicates removal (end point of processing) of a metal layer (copper film), B indicates removal of a first barrier layer and C indicates removal of a second barrier layer. Though the change in the oscillation frequency per se is thus slight, detection of the end point of electrolytic processing for a barrier layer having an angstrom-order thickness can be made with ease by observing the derivative value.

Figure 11:
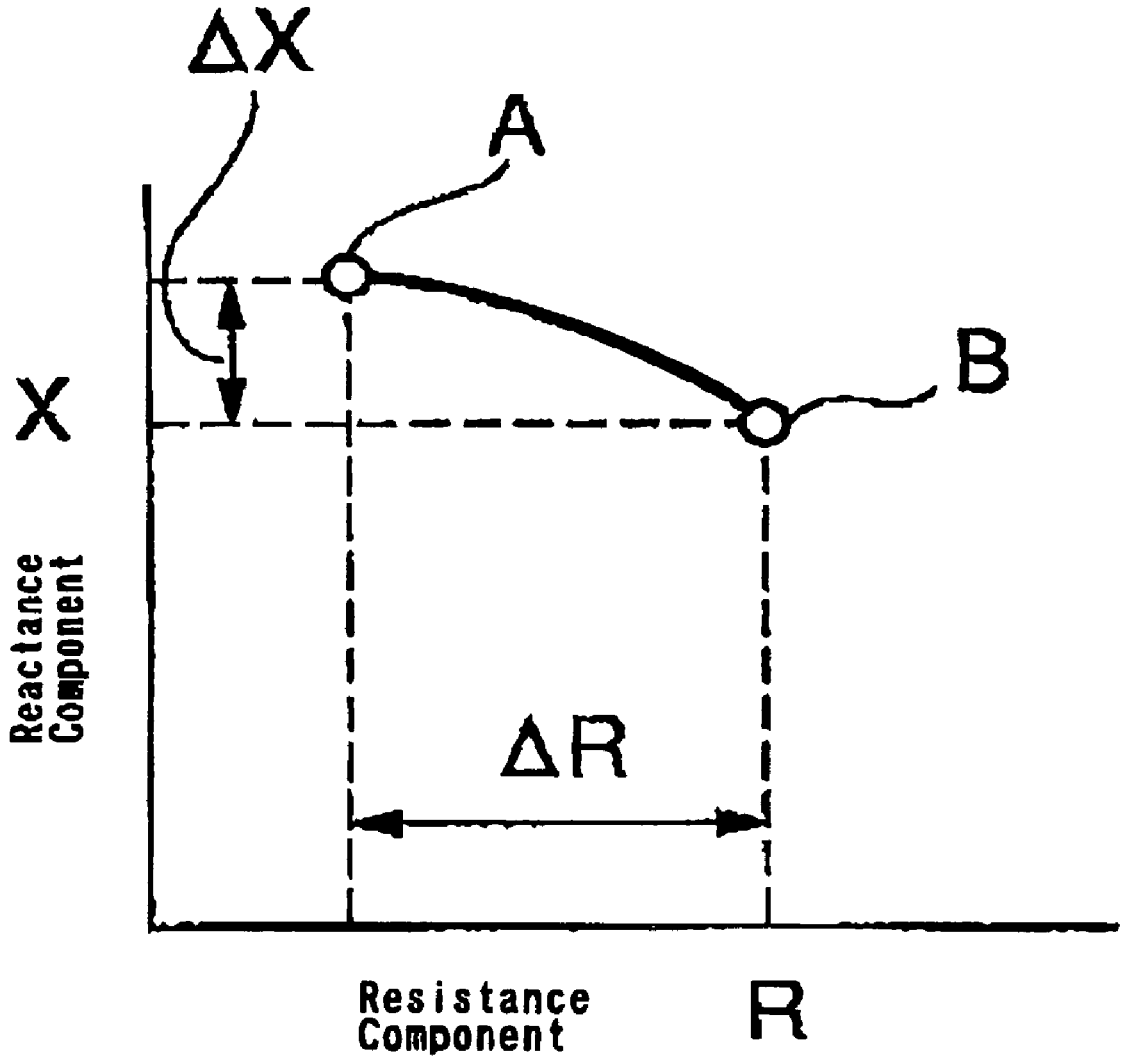
FIG. 11 is a graph showing a change in the equivalent impedance measured with an LCR meter.

The second method for detecting an eddy current loss is direct measurement with an LCR meter of the resistance component of the equivalent impedance of the eddy current loss in the sensor coil 111. When an LCR meter is used as the signal detection section in FIG. 8, the monitor screen displays the resistance component R along the abscissa and the reactance component X along the ordinate, as shown in FIG. 11. The eddy current loss changes with the progress of electrolytic processing of a conductive film, and changes in the resistance value R and in the reactance value X with the change in the eddy current loss can be observed.

In particular, point B in FIG. 11 indicates a substantial presence of a conductive film with a large eddy current loss, while point A indicates absence of the conductive film after its removal by electrolytic processing with no eddy current loss, with only the fixed resistance portion viewed from the impedance meter side left. As shown in FIG. 11, the following inequality holds with the impedance change in the sensor:

$$\Delta R >> \Delta X$$

Thus, the change in the resistance component ($\Delta R$) is much larger than the change in the reactance component ($\Delta X$). In case the measurement results by the eddy current sensor deviate from a predetermined range during operation of the electrolytic processing apparatus, a sensor failure is judged and an error signal is generated. The electrolytic processing may then be stopped to minimize the effects of the abnormal time.

Next, substrate processing (electrolytic processing) by using the electrolytic processing apparatus 34 of this embodiment will be described. First, a substrate, e.g. a substrate W, as shown in FIG. 1B, which has in its surface a copper film 6 and a barrier layer 5 as conductive films (processing objects), is taken by the transport robot 36 out of the cassette housing substrates and set in the loading/unloading section 30. If necessary, the substrate W is transferred to the reversing machine 32 by the transport robot 36 to reverse the substrate W so that the front surface of the substrate W having the conductor film (copper film 6) faces downwardly.

The transport robot 36 receives the reversed substrate W, and transfers it to the electrolytic processing apparatus 34. The substrate W is attracted and held by the substrate holder 42. The pivot arm 40 is moved to move the substrate holder 42 holding the substrate W to a processing position right above the processing table 44. Next, the vertical-movement motor 60 is driven to lower the substrate holder 42 so as to bring the substrate W held by the substrate holder 42 close to or into contact with the surface of the ion exchanger 56 on the processing table 44. It is to be noted here that when a liquid like ultrapure water which itself has a large resistivity is used, the electric resistance can be lowered by bringing the ion exchanger 56 into contact with the substrate W, whereby the requisite voltage can also be lowered and hence the power consumption can be reduced. The "contact" does not imply "press" for giving a physical energy (stress) to a workpiece as in CMP. Accordingly, the electrolytic processing apparatus of this embodiment employs the vertical-movement motor 60 for bringing the substrate W into contact with or close to the processing table 44, and does not have such a press mechanism as usually employed in a CMP apparatus that presses a substrate against a polishing member aggressively. This also holds true for other embodiments to be described later.

In this regard, according to a CMP apparatus, a substrate is pressed against a polishing surface generally at a pressure of about 20-50 kPa, whereas in the electrolytic processing apparatus of this embodiment, the substrate W may be contacted with the ion exchanger 56 at a pressure of less than 20 kPa. Even at a pressure less than 10 kPa, a sufficient removal processing effect can be achieved.

Substantially in the same manner with the regeneration section 80, the pivot arm 82 is moved to move the regeneration head 84 to a processing position right above the processing table 44. Then, the regeneration head 84 is lowered so as to bring the regeneration electrode 86 attached to the lower surface of the regeneration head 84 close to or into contact with the surface of the ion exchanger 56 on the processing table 44.

Thereafter, in the electrode plates 74 facing the substrate W held by the substrate holder 42, the processing electrodes 50 are connected to the cathode of the processing power source 78 and the feeding electrodes 52 are connected to the anode of the processing power source 78, via a slip ring 76, and a given voltage is applied to between the processing electrodes 50 and the feeding electrodes 52. In the regeneration section 80, the regeneration electrode 86 is connected to the cathode of the regeneration power source 88 and the electrode plates 76 facing the regeneration electrode 86 are connected, via a slip ring 90, to the anode of the regeneration power source 88, and a given voltage is applied between the regeneration electrode 88 and the electrode plates 74. Then, the substrate holder 42 and the processing table 44 are rotated.

At the same time, pure water or ultrapure water is supplied, through the through-hole formed in the processing table 44, from beneath the processing table 44 to the upper surface thereof, and simultaneously, pure water or ultrapure water is supplied, through the pure water nozzle 72, from above the processing table 44 to the upper surface thereof, thereby filling pure water or ultrapure water into the spaces between the processing table 44 and the substrate W held by the substrate holder 42, and between the processing table 44 and the regeneration electrode 86. Furthermore, in the electrode section 80, pure water preferably ultrapure water is supplied to between the processing table 44 and the regeneration electrode 86, and discharged from therebetween.

In this manner, electrolytic processing of the conductor film (copper film 6 or barrier layer 5) formed in the surface of the substrate W is carried out at the processing electrodes 50 through the action of hydrogen ions or hydroxide ions produced by the ion exchanger 56, while regenerating the ion exchanger 56 with the regeneration section 80. According to the above electrolytic processing apparatus, a large amount of hydrogen ions or hydroxide ions can be produced by allowing pure water or ultrapure water to flow within the ion exchanger 56, and the large amount of such ions can be supplied to the surface of the substrate W, whereby the electrolytic processing can be conducted efficiently.

More specifically, by allowing pure water or ultra pure water to flow within the ion exchanger 56, a sufficient amount of water can be supplied to a functional group (sulfonic acid group in the case of an ion exchanger carrying a strongly acidic cation-exchange group) thereby to increase the amount of dissociated water molecules, and the process product (including a gas) formed by the reaction between the conductor film and hydroxide ions (or OH radicals) can be removed by the flow of water, whereby the processing efficiency can be enhanced. The flow of pure water or ultrapure water is thus necessary, and the flow of water should desirably be constant and uniform. The constancy and uniformity of the flow of water leads to constancy and uniformity in the supply of ions and the removal of the process product, which in turn leads to constancy and uniformity in the processing.

During electrolytic processing, the thickness of a conductive film (copper film 6 or barrier film 5) being processed is measured in situ by the eddy current sensor 110 provided in the processing table 44 so as to detect the end point of electrolytic processing based on the results of measurement.

After completion of the electrolytic processing, the processing power source 78 and the regeneration power source 88 are disconnected, and the rotations of the substrate holder 42 and the processing table 44 are stopped. Thereafter, the substrate holder 42 is raised, and the substrate W is transferred to the transport robot 36 after moving the pivot arm 40. The transport robot 36 takes the substrate W from the substrate holder 42 and, if necessary, transfers the substrate W to the reversing machine 32 for reversing it. The transport robot 36 transports the substrate W to the first cleaning machine 31*a*, where a primary cleaning of the substrate is carried out, and substrate W is then transported to the second cleaning machine 31*b*, where a secondary cleaning (finish cleaning) of the substrate is carried out. The substrate is then dried, and the dried substrate is returned to the cassette of the loading/unloading section 30.

When electrolytic processing is performed without interposing an ion exchanger between the processing electrode and the workpiece, the electric resistance is proportional to "the distance between the workpiece and the processing electrode (electrode-to-electrode distance)". This is because as the distance of ion migration becomes smaller, the less energy is required for ion migration. In the presence of ultrapure water (18.25 MΩ·cm), for example, the electric resistance is 18.25 MΩ (0.54 μA at a voltage of 10 V) at the electrode-to-electrode distance of 1 cm, and 1.825 KΩ (5.4 mA at a voltage of 10 V) at the electrode-to-electrode distance of 1 μm.

In the case where an ion exchanger is interposed between the processing electrode and the workpiece, when the ion exchanger is brought close to the workpiece, but not into contract with it, the electric resistance is basically proportional to the "distance between the workpiece and the surface of the ion exchanger" as in the above case. When the ion exchanger is contacted with the workpiece, however, the electric resistance decreases to a further degree. This is ascribable to a large difference in ion concentration between the inside and outside of the ion exchanger.

More specifically, in the inside of the ion exchanger, electrolytic dissociation of ultrapure water is promoted by the catalytic action whereby the concentration of ions ($H^+$ and $OH^-$) increases. Thus, the inside of the ion exchanger, due to the presence of an ion-exchange group, becomes a special field in which a high concentration of ions is (or can be) accumulated. In the outside of the ion exchanger, on the other hand, due to the absence of an ion-exchange group, the increased ions tend to return to the original state ($H_2O$) whereby the ion concentration is remarkably lower.

Accordingly, by bringing the ion exchanger into contact with the workpiece, the electric resistance can be kept at a certain low level irrespective of the distance between the workpiece and the processing electrode when the ion exchanger is in contact with the workpiece.

This embodiment shows the case of supplying pure water, preferably ultrapure water, between the processing table 44 and the substrate W. The use of pure water or ultrapure water containing no electrolyte upon electrolytic processing can prevent impurities such as an electrolyte from adhering to and remaining on the surface of the substrate W. Further, copper ions or the like dissolved during electrolytic processing are immediately caught by the ion exchanger 56 through the ion-exchange reaction. This can prevent the dissolved copper ions or the like from re-precipitating on the other portions of the substrate W, or from being oxidized to become fine particles which contaminate the surface of the substrate W.

Ultrapure water has a high resistivity, and therefore an electric current is hard to flow therethrough. A lowering of the electric resistance is made by making the distance between the electrode and a workpiece as small as possible, or by interposing the ion exchanger between the electrode and a workpiece. Further, an electrolytic solution, when used in combination with ultrapure water, can further lower the electric resistance and reduce the power consumption. When electrolytic processing is conducted by using an electrolytic solution, the portion of a workpiece that undergoes processing ranges over a slightly wider area than the area of the processing electrode. In the case of the combined use of ultrapure water and the ion exchanger, on the other hand, since almost no electric current flows through ultrapure water, electric processing is effected only within the area of a workpiece that is equal to the area of the processing electrode and the ion exchanger.

It is possible to use, instead of pure water or ultrapure water, an electrolytic solution obtained by adding an electrolyte to pure water or ultrapure water. The use of such an electrolytic solution can further lower the electric resistance and reduce the power consumption. A solution of a neutral salt such as NaCl or $Na_2SO_4$, a solution of an acid such as HCl or $H_2SO_4$, or a solution of an alkali such as ammonia, may be used as the electrolytic solution, and these solutions may be selectively used according to the properties of the workpiece. When the electrolytic solution is used, it is preferred to provide a slight interspace between the substrate W and the ion exchanger 56 so that they are not in contact with each other.

Further, it is also possible to use, instead of pure water or ultrapure water, a liquid obtained by adding a surfactant or the like to pure water or ultrapure water, and having an electric conductivity of not more than 500 μS/cm, preferably not more than 50 μS/cm, more preferably not more than 0.1 μS/cm (resistivity of not less than 10 MΩ·cm). Due to the presence of a surfactant, the liquid can form a layer, which functions to inhibit ion migration evenly, at the interface between the substrate W and the ion exchanger 56, thereby moderating concentration of ion exchange (metal dissolution) to enhance the flatness of the processed surface. The surfactant concentration is desirably not more than 100 ppm. When the value of the electric conductivity is too high, the current efficiency is lowered and the processing rate is decreased. The use of the liquid having an electric conductivity of not more than 500 μS/cm, preferably not more than 50 μS/cm, more preferably not more than 0.1 μS/cm, can attain a desired processing rate.

According to the present invention, the processing rate can be considerably enhanced by interposing the ion exchanger 56 between the substrate W and the processing and feeding electrodes 50, 52. In this regard, electrochemical processing using ultrapure water is effected by a chemical interaction between hydroxide ions in ultrapure water and a material to be processed. However, the amount of the hydroxide ions acting as reactant in ultrapure water is as small as $10^{-7}$ mol/L under normal temperature and pressure conditions, so that the removal processing efficiency can decrease due to reactions (such as an oxide film-forming reaction) other than the reaction for removal processing. It is therefore necessary to increase hydroxide ions in order to conduct removal processing efficiently. A method for increasing hydroxide ions is to promote the dissociation reaction of ultrapure water by using a catalytic material, and an ion exchanger can be effectively used as such a catalytic material. More specifically, the activation energy relating to water-molecule dissociation reaction is lowered by the interaction between functional groups in an ion exchanger and water molecules, whereby the dissociation of water is promoted to thereby enhance the processing rate.

It may be possible to omit the ion exchanger 56, and supply pure water or ultrapure water between the substrate W and the processing and feeding electrodes 50, 52. Though the processing rate is lowered by the omission of the ion exchanger 56, the electrolytic processing is effective especially for removing an extremely thin film. Moreover, this excludes the possibility that extra impurities such as an electrolyte will adhere to and remain on the surface of the substrate W.

Further, according to this embodiment, the ion exchanger 56 is brought into contact with or close to the substrate W upon electrolytic processing. When the ion exchanger 56 is positioned close to the substrate W, though depending on the distance therebetween, the electric resistance is large to some degree and, therefore, a somewhat large voltage is necessary to provide a requisite electric current density. However, on the other hand, because of the non-contact relation, it is easy to form flow of pure water or ultrapure water along the surface of the substrate W, whereby the reaction product produced on the substrate surface can be efficiently removed. In the case where the ion exchanger 56 is brought into contact with the substrate W, the electric resistance becomes very small and therefore only a small voltage needs to be applied, whereby the power consumption can be reduced.

If a voltage is raised to increase the current density in order to enhance the processing rate, an electric discharge can occur when the electric resistance between the electrode and the substrate (workpiece) is large. The occurrence of electric discharge causes pitching on the surface of the workpiece, thus failing to form an even and flat processed surface. To the contrary, since the electric resistance is very small when the ion exchanger 56 is in contact with the substrate W, the occurrence of an electric discharge can be avoided.

According to this embodiment, the ion exchanger 56 is used as a member containing an electrolyte. Instead of the ion exchanger 56, another contact member may be used, and electrolytic processing is performed while keeping the contact member in contact with the surface of the substrate W. An insulator or an electrically conductive pad may be used as the contact member. Alternatively, a combination of a member containing an electrolyte, such as an ion exchanger, an insulator and an electrically conductive pad may be used as the contact member.

Figure 12:
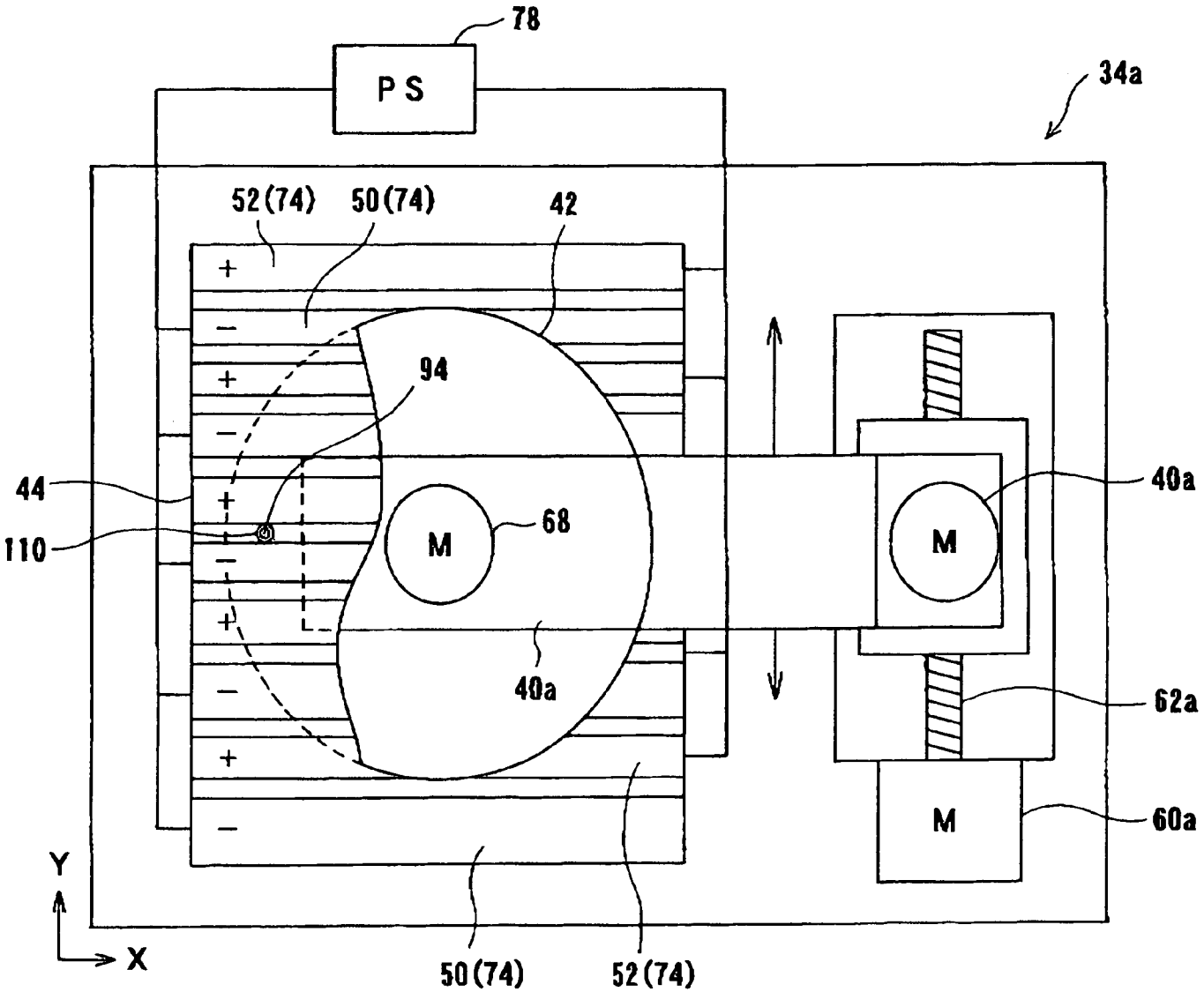
FIG. 12 is a partially cutaway plan view of an electrolytic processing apparatus according to another embodiment of the present invention.

FIG. 12 shows an electrolytic processing apparatus 34*a* according to another embodiment of the present invention. This embodiment employs a rectangular fixed-type processing table 44 and a substrate holder 42 which is vertically movable and horizontally reciprocatable without pivoting. Electrode plates 74, extending over the full length of the rectangular processing table 44 in the width direction, are disposed evenly spaced apart and parallel to one another at a given pitch on the upper surface of the processing table 44. The electrode plates 74 are to be connected alternately to a cathode and an anode of a processing power source 78, and the electrode plates 74 connected to the cathode of the processing power source 78 serve as processing electrodes 50, while the electrode plates 74 connected to the anode serve as feeding electrodes 52.

The substrate holder 42, on the other hand, is secured to the free end of a vertically-movable arm 40*a* that moves vertically via a ball screw by the actuation of a vertically-moving motor 60*a*. Further, the substrate holder 42 rotates by the actuation of a rotating motor 68, and reciprocates in the direction perpendicular to the electrode plates 74, together with the vertically-movable arm 40*a*, via a ball screw 62*a*, by the actuation of a reciprocating motor 60*a*. Though not shown diagrammatically, the upper surfaces of the processing electrodes 50 and the feeding electrodes 52 are covered with ion exchangers.

An eddy current sensor 110, surrounded by an insulator 94, is disposed between a processing electrode 50 and a feeding electrode 52. If there is a space between a processing electrode 50 and a feeding electrode 52 where the eddy current sensor 110 can be disposed without contact with the electrodes 50, 52, as in this embodiment, the eddy current sensor 110 may be disposed in the space not in contact with the processing electrode 50 and the feeding electrode 52. The eddy current sensor 110 may be provided in desired numbers.

According to the electrolytic processing apparatus 34*a*, while keeping a substrate W held by the substrate holder 42 close to or in contact with the ion exchanger, the substrate W is rotated via the substrate holder 42 and, at the same time, the substrate holder 42 is reciprocated by the actuation of the reciprocating motor 60*a* while pure water or ultrapure water is supplied onto the upper surface of the processing table 44 and a given voltage is applied between the processing electrodes 50 and the feeding electrodes 52. While the surface of the substrate W is electrolytically processed in this manner, the thickness of a conductive film (copper film 6 or barrier film 5) being processed is measured in situ by the eddy current sensor 110 provided in the processing table 44 so as to detect the endpoint of electrolytic processing based on the results of measurement.

Figure 13A:
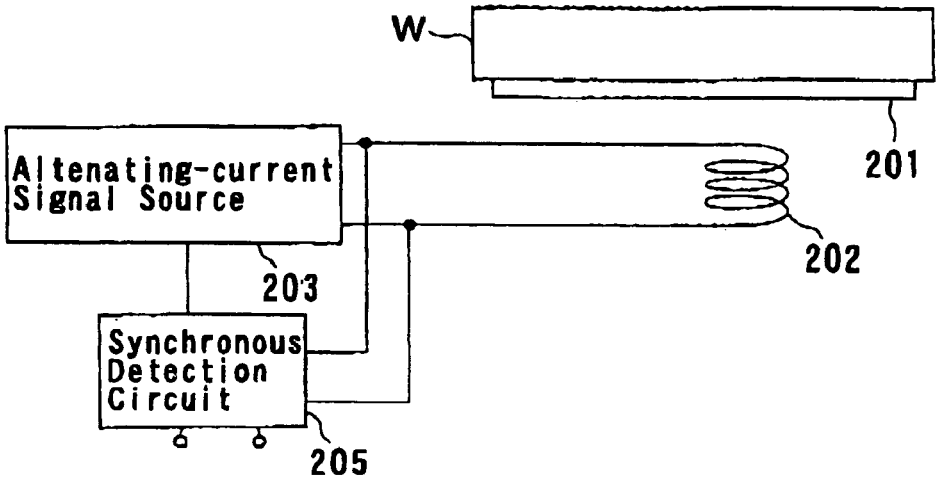
FIG. 13A is a diagram showing the construction of another eddy current sensor.

FIG. 13A shows another eddy current sensor. The eddy current sensor comprises a sensor coil 202 to be disposed in the vicinity of a conductive film 201 to be detected, such as the copper film 6 and the barrier layer 5 formed on the substrate W shown in FIG. 1B, and an alternating-current signal source 203 connected to the sensor coil 202. The conductive film to be detected is, for example, the copper film 6 having a thickness of about 0 to 1 μm or the underlying barrier layer 5 having an angstrom-order thickness, formed on the substrate W shown in FIG. 1B. The barrier layer 5 is a high-resistance layer of Ta, TaN or Tin. The sensor coil 202 is a coil of one to several turns, and is disposed in the vicinity, for example about 10 to 20 mm, of the conductive film to be detected. The alternating-current signal source 203 is an oscillator with a fixed frequency of about 8 to 32 MHz, and a quartz oscillator, for example, is employed.

A synchronous detection circuit 205 for detecting with the sensor coil 202 an eddy current generated in the conductive film 201 is connected to the end of the sensor coil 202. The synchronous detection circuit 205 can measure the impedance on the sensor coil 202 side including the conductive film 201.

Figure 13B:
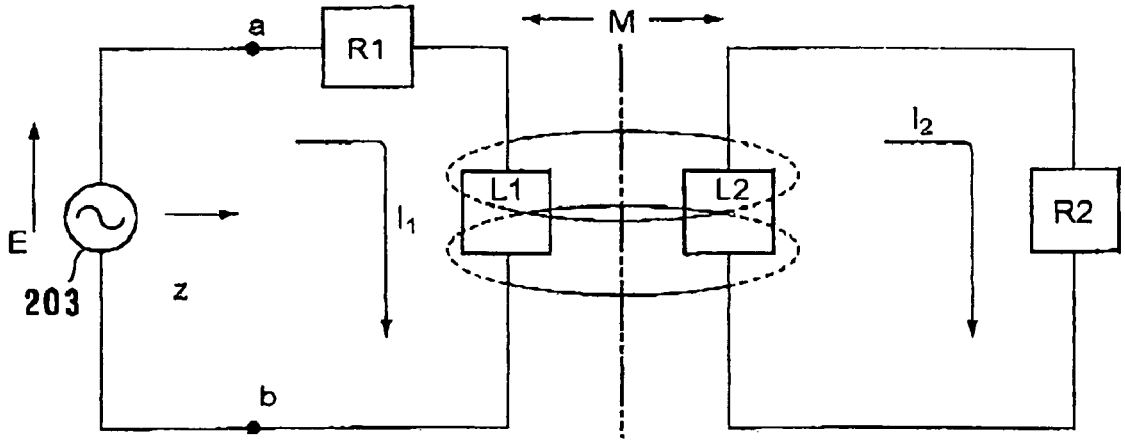
FIG. 13B is a diagram showing an equivalent circuit of the sensor of FIG. 13A.

FIG. 13B shows an equivalent circuit of the circuit formed between the alternating-current signal source 203, the sensor coil 202 and the conductive film 201. An electric current $I_1$ flows in the sensor coil 202 by an alternating voltage applied by the alternating-current signal source 203. A magnetic flux, which is generated by the electric current flowing in the coil 202 disposed in the vicinity of the conductive film 201, interlinks the conductive film 201 whereby a mutual inductance M is formed between the conductive film 201 and the sensor coil 202, and an eddy current $I_2$ flows in the conductive film 201. In FIG. 13B, R1 denotes the equivalent resistance on the primary side including the sensor coil 202 and L1 denotes the self-inductance on the primary side including the sensor coil 202, while R2 on the conductive film 202 side denotes the equivalent resistance corresponding to an eddy current loss and L2 denotes its self-inductance. The impedance Z on the sensor coil side, as viewed from the terminals a, b of the alternating-current signal source 203, changes in response to an eddy current loss in the conductive film 201.

Figure 14:
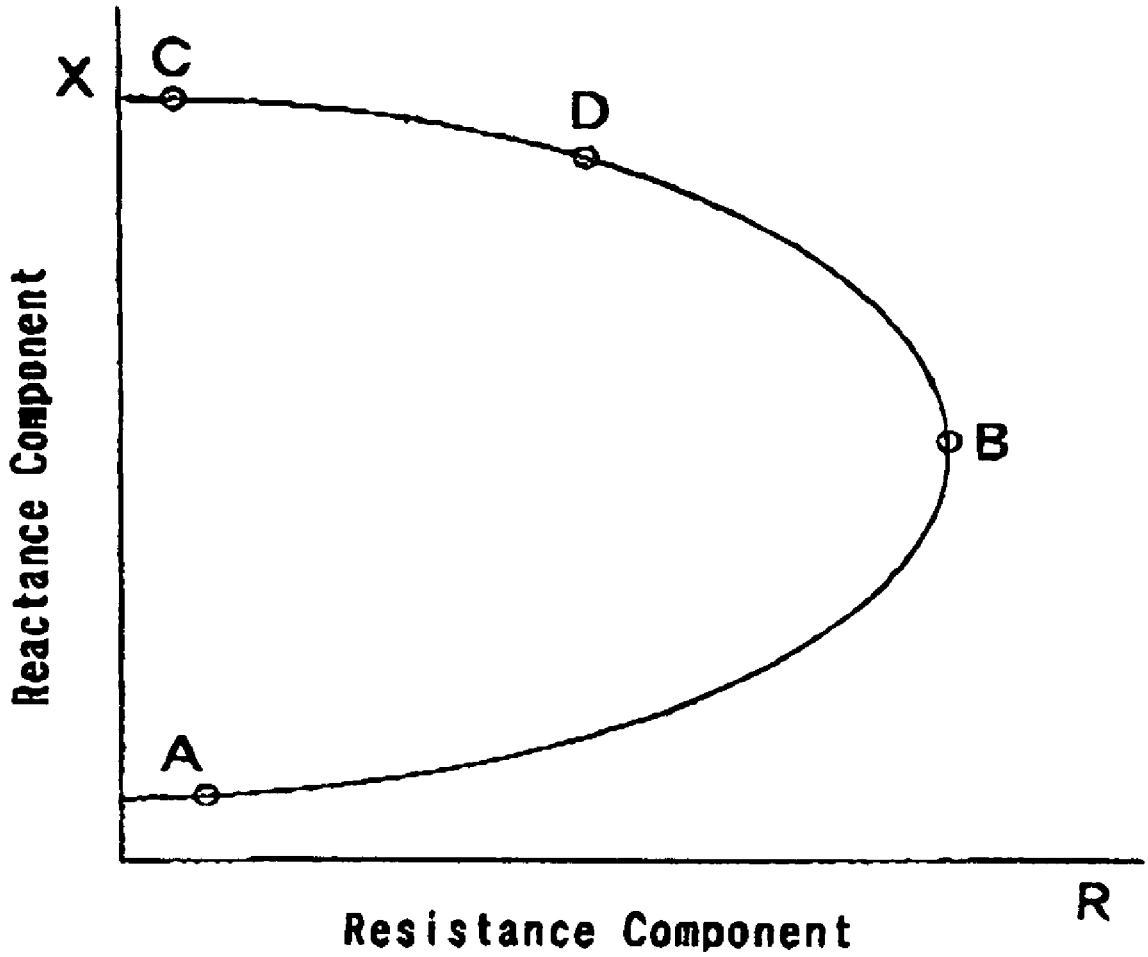
FIG. 14 is a graph showing a change in the resistance component (R) and the reactance component (X) in the eddy current sensor shown in FIG. 13A with a change in the thickness of a conductive film being processed.

FIG. 14 shows a change in the impedance Z, as viewed from the alternating-current signal source side, with the resistance component (R) plotted along the abscissa and the reactance component (X) along the ordinate. Point A indicates a very large film thickness, for example, over 100 μm. In this case, the impedance Z on the sensor coil 202 side, as viewed from the terminals a, b of the alternating-current signal source 203 become as follows: The eddy current in such a conductive film 201, positioned in the vicinity of the sensor coil 202, is very high, and the resistance component ($R_2$) and the reactance component $j\omega(M+L_2)$, which are connected equivalent to and in parallel with the sensor coil 202, are very small. Accordingly, the resistance component (R) and the reactance component (X) are both small.

As the conductive film 201 becomes thinner with the progress of electrolytic processing, as to the impedance Z, as viewed from the sensor coil end (terminals a, b), the resistance component ($R_2$) and the reactance component $j\omega(M+L_2)$ both increase. Point B represents a point at which the resistance component (R) of the impedance Z, as viewed from the sensor coil end (terminals a, b), reaches the maximum. At this time, the eddy current loss, as viewed from the sensor coil end (terminals a, b), reaches the maximum. As the conductive film 201 becomes further thinner with the further progress of electrolytic processing, the eddy current decreases and the resistance component (R), as viewed from the sensor coil end (terminals a, b), gradually decreases due to a gradual decrease in eddy current loss. When the conductive film 201 is completely removed by electrolytic processing, there is no eddy current loss any more and the resistance component ($R_2$), which is connected equivalent to and in parallel, becomes infinite, leaving only the resistance component ($R_1$) of the sensor coil itself. The reactance component (X) is equal to the reactance component ($L_1$) of the sensor coil itself. The impedance Z at that point in time is shown by point C.

In the practical formation of embedded interconnects of e.g. copper by a so-called damascene process in interconnect trenches provided in e.g. a silicon oxide film, a barrier layer of tantalum nitride (TaN), titanium nitride (TiN), or the like is formed on the silicon oxide film and metal interconnects of a metal having a high electric conductivity, such as copper or tungsten, are formed on the barrier layer. Accordingly, in electrolytic processing of these conductive films, detection of the end point of electrolytic processing for the barrier layer is of importance. As described above, however, the barrier layer is a very thin film with an angstrom-order thickness, composed of TaN, TiN or the like material having a relatively low electric conductivity.

The eddy current sensor of this embodiment enables easy detection of the film thickness of such a barrier layer near the end point of electrolytic processing. In particular, point D shown in FIG. 14 indicates a point in time at which the film thickness is e.g. about 1000 Å. The resistance component changes widely and almost linearly from point D to point C, at which the film thickness is zero, with a change in the film thickness. In contrast, the reactance component (X) changes only slightly as compared to the resistance component, as shown in FIG. 14. Thus, according to a conventional eddy current sensor which detects the film thickness based on a change in the oscillation frequency caused by a change in the reactance component, the change in the oscillation frequency with a change in the film thickness is very small. It has, therefore, been necessary to increase the frequency in order to increase the resolution of the frequency change. The present eddy current sensor, on the other hand, detects a change in the film thickness by observation of a change in the resistance component with a fixed oscillation frequency, which makes it possible to clearly observe the state of the very thin barrier layer film being processed with a relatively low frequency.

Figure 15A:
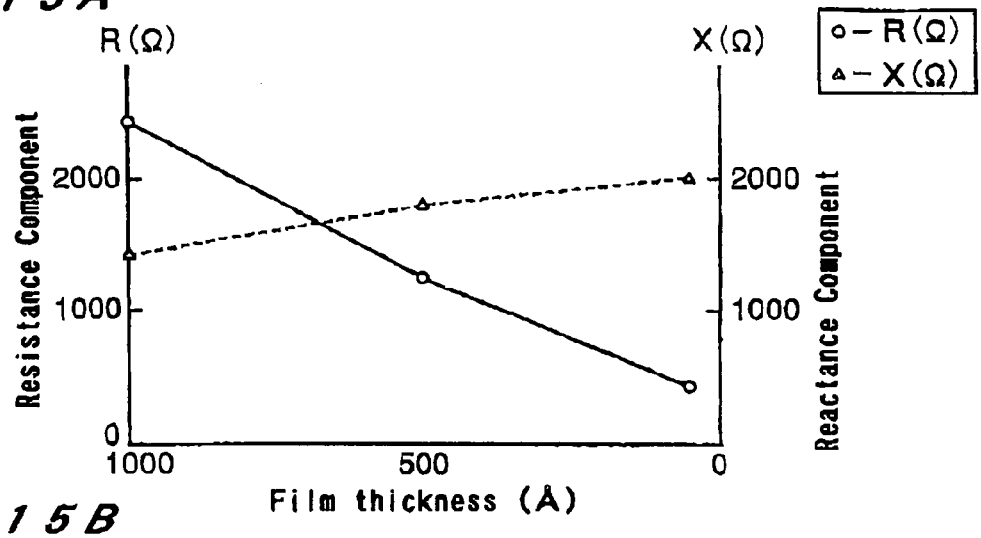
FIGS. 15A through 15C are graphs each showing a change in the component (R) and the reactance component (X) in the eddy current sensor shown in FIG. 13A with a change in the thickness of a different type of conductive film being processed.
Figure 15B:
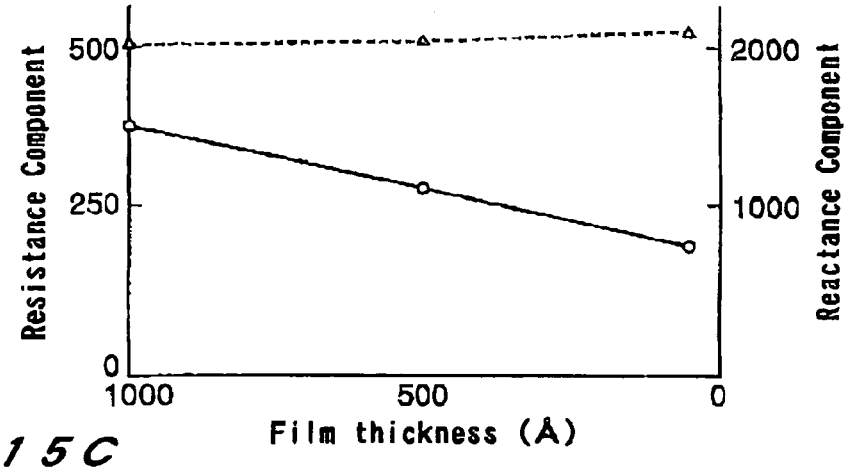
Figure 15C:
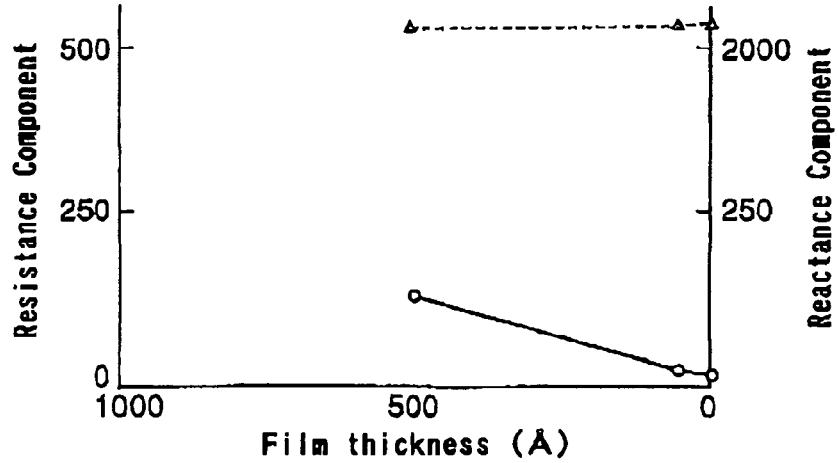

FIGS. 15A through 15C show the results of detection of the film thickness of various angstrom-order thin conductive films. The film thickness is plotted along the abscissa, while the resistance component (R) is plotted by the solid line and the reactance component (X) is plotted by the broken line along the ordinate. FIG. 15A shows the data on a tungsten (W) film. As will be appreciated from FIG. 15A, a change in the film thickness can be detected clearly by observation of the resistance component even when the film is as thin as less than 1000 Å. FIG. 15B shows the data on a titanium nitride (TiN) film. A change in the film thickness in the range of 0-1000 Å can be detected clearly. FIG. 15C shows the data on a titanium (Ti) film. As shown in FIG. 15C, the resistance component changes widely with the change in the film thickness from 500 to 0 Å, enabling clear detection of the film thickness change.

The oscillation frequency of the alternating-current signal source is preferably set at a high frequency, for example, 32 MHz for the detection of a barrier layer having a relatively low electric conductivity. The use of a high oscillation frequency enables clear observation of a change in the film thickness of the barrier layer over the range of 0 to 250 Å. In the case of a metal having a relative high electric conductivity, such as copper, on the other hand, clear detection of a change in the film thickness is possible even with a low oscillation frequency, for example, 8 MHz. Further, in the case of a tungsten film, an oscillation frequency of about 16 MHz is suitably employed. The oscillation frequency may thus be appropriately selected depending upon the type of the film to be processed electrolytically.

In the cases shown in FIGS. 15A through 15C, the change in the reactance component (X) is very small as compared to the change in the resistance component (R). In an experiment in which the thickness of a tantalum film as a barrier layer was detected, the change in the reactance component (X) was 0.005% when the film thickness changed from 250 Å to 0 Å, while the change in the resistance component (R) was 1.8%. Thus, in this case, the detection sensitivity is about 360 times higher with the present detection method as compared to the conventional detection method that relies on a change in the reactance component.

Figure 16:
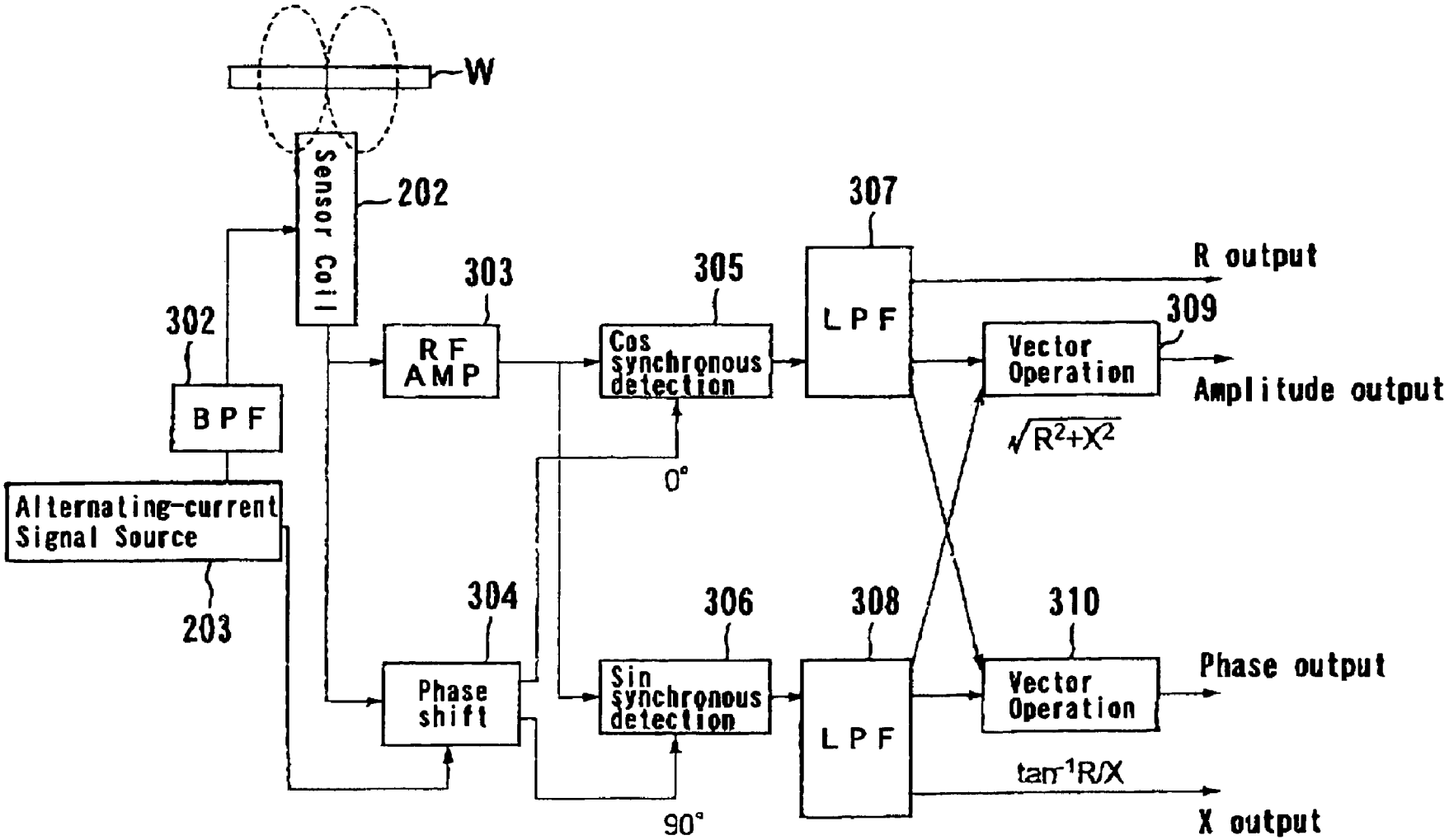
FIG. 16 is a diagram showing a synchronous detection circuit.

FIG. 16 shows a circuit for measuring the impedance Z on the sensor coil side as viewed from the alternating-current signal source. While the above-described detection of film thickness is principally based on a change in the resistance component (R), the measurement circuit of the impedance Z shown in FIG. 16 can detect changes in the resistance component (R), the reactance component (X), the amplitude output (Z) and the phase output ($\tan^{-1} R/X$) with a change in film thickness. By using such output signals, multifaceted monitoring of the progress of electrolytic processing, such as measurement of film thickness from the amplitude, becomes possible.

The sensor coil 202 is disposed in the vicinity of a substrate W having a conductive film as a detection object. The signal source 203, which supplies an alternating-current signal to the sensor coil 202, is a fixed-frequency oscillator comprised of a quartz oscillator and supplies a voltage having a fixed frequency, for example, 8, 16 or 32 MHz. The alternating voltage generated by the signal source 203 is supplied via a band pass filter 302 to the sensor coil 202. The signal detected at the terminal of the sensor coil 202 is inputted via a radiofrequency amplifier 303 and a phase shift circuit 304 to a synchronous detection section comprised of a cos synchronous detection circuit 305 and a sin synchronous detection circuit 306, where the cos component and the sin component of the detected signal are taken out. In the phase shift circuit 304, the inphase component (0°) and the orthogonal component (90°) of the oscillation signal generated by the alternating-current signal source 203 are taken out, and the two signals are respectively introduced into the cos synchronous detection circuit 305 and the sin synchronous detection circuit 306 for the above-described synchronous detection.

The synchronously-detected signals are transmitted to low pass filters 307, 308, where an unnecessary high-frequency component is cut off, and the resistance component (R) output, which is the cos synchronous detection output, and the reactance component (X) output, which is the sin synchronous detection output, are taken out. An amplitude output ($\sqrt{R^2+X^2}$) is obtained from the resistance component (R) output and the reactance component (X) output by a vector operation circuit 309. Further, a phase output ($\tan^{-1} R/X$) is obtained from the resistance component output and the reactance component output by a vector operation circuit 310.

Figure 17:
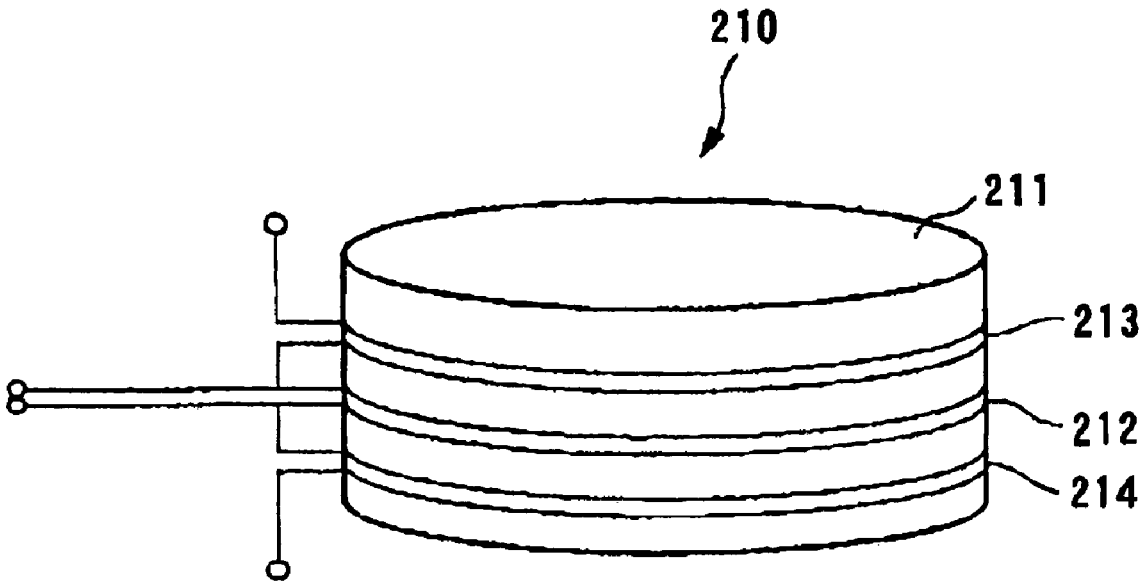
FIG. 17 is a diagram showing a sensor coil.

FIG. 17 shows a sensor coil for use in an eddy current sensor. The sensor coil 210 comprises three-layer coils 212, 213, 214 wound on a bobbin 211, in which a coil for generating an eddy current in a conductive film is separated from a coil for detecting the eddy current in the conductive film. The central coil 212 is an oscillation coil connected to the alternating-current signal source 203. The oscillation coil 212 generates an eddy current in a conductive film on a substrate W disposed near the coil by the magnetic filed formed by an electric current supplied from the alternating-current signal source 203. A detection coil 213 is disposed on the upper side (conductive film side) of the bobbin 211 and detects the magnetic field generated by the eddy current flowing in the conductive film. A balance coil 214 is disposed on the opposite side of the oscillation coil 212 from the detection coil 213.

According to this embodiment, the coils 212, 213, 214 are of the same number of turns (e.g. 4 turns), and the detection coil 213 and the balance coil 214 are connected in reverse phase connection. Thus, the electrical connection is made such that the electromotive forces generated for a line of magnetic flux interlinking the coils 213, 214 counteract each other. The diameter of the coils 212, 213, 214 is, for example, about 15 mm.

Figure 18:
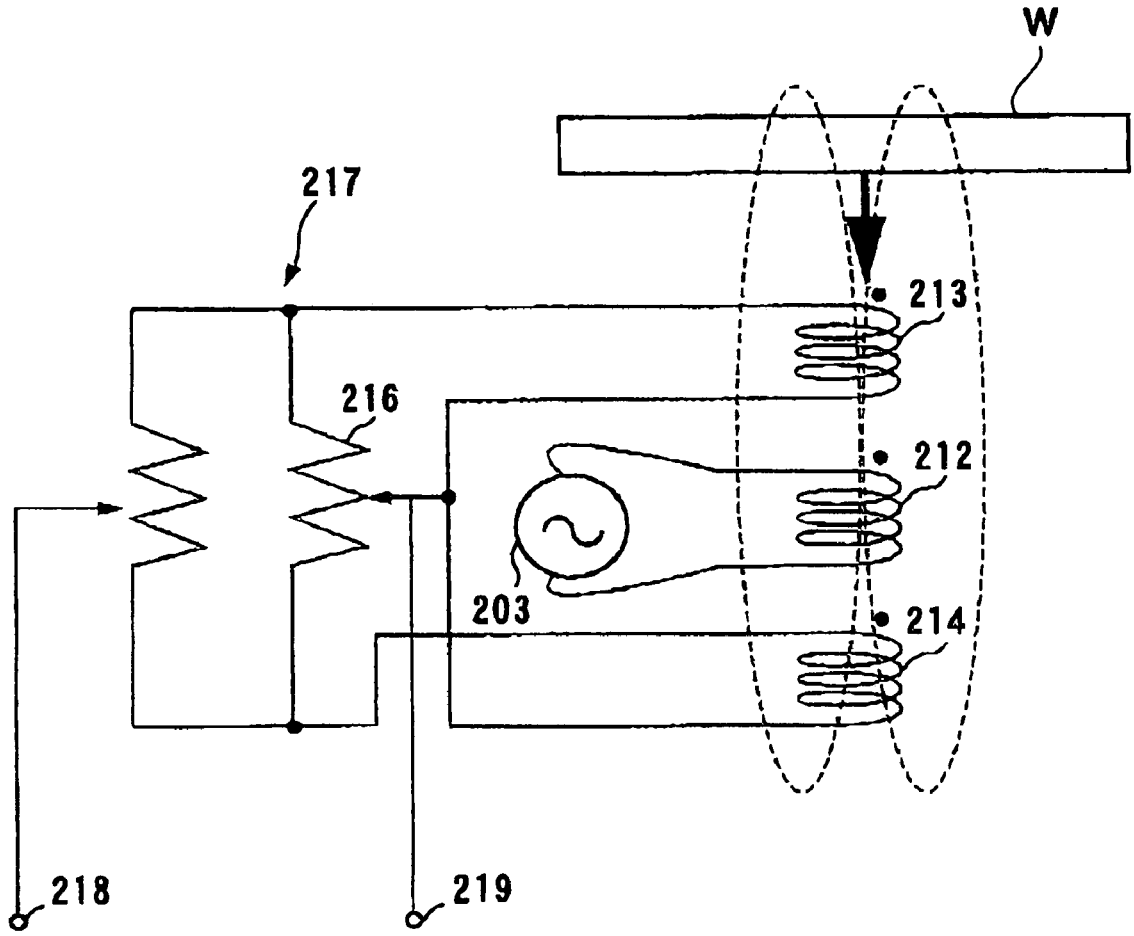
FIG. 18 is a diagram showing an example of the electrical connection of the sensor coil shown in FIG. 17.

FIG. 18 shows an example of the electrical connection of each coil. The detection coil 213 and the balance coil 214 form a series circuit, as described above, and the circuit ends are connected to a resistance bridge circuit 217 including a variable resistance 216, as shown in FIG. 18. By adjusting the resistance value of the variable resistance 216, the output voltage of the series circuit of the coils 213, 214 can be adjusted so that it becomes zero when a conductive film is not present. The coil 212 is connected to the alternating-current signal source 203 and generates an alternate magnetic flux, thereby generating an eddy current in a conductive film disposed in the vicinity of the coil. The variable resistance 216 is adjusted so that the output of the series circuit of the coils 213, 214 in reverse phase connection becomes zero when a conductive film is not present in the vicinity of the sensor coil 210 and thus there is no eddy current. Accordingly, though the coil 212 generates an alternate magnetic flux, no output is produced by the series circuit of the coils 213, 214 in reverse phase connection.

When a conductive film is present in the vicinity of the detection coil 213, a magnetic flux, which is generated by an eddy current generated in the conductive film, interlinks the detection coil 213 and the balance coil 214. Since the detection coil 213 is disposed closer to the conductive film, the induced voltages in the two coils 213, 214 are imbalanced, whereby the magnetic flux linkage generated by the eddy current in the conductive film can be detected. The zero point adjustment thus becomes possible by separating the series circuit of the detection coil 213 and the balance coil 214 from the oscillation coil 212 connected to the alternating-current signal source, and making the balance adjustment with the resistance bridge circuit. Accordingly, it becomes possible to detect an eddy current flowing in the conductive film from the zero level, increasing the detection sensitivity for the eddy current. It thus becomes possible to detect the intensity of an eddy current generated in a conductive film with a width dynamic range.

Figure 19A:
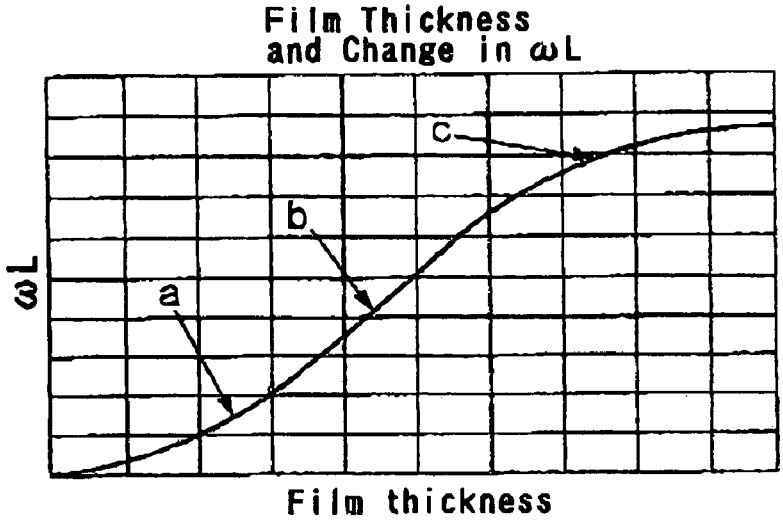
FIG. 19A is a graph showing a change in the reactance component of a synchronous detection output with a change in the thickness of a conductive film.

FIG. 19A shows a change in the reactance component X (=ωL) of the synchronous detection output, which appears on the detection terminal side of the sensor coil 210 with a change in the film thickness of a conductive film, against a change in the film thickness of a conductive film. In the relationship between the change in the film thickness of the conductive film and the change in the reactance component, the reactance component X changes as shown in the Figure as the film thickness decreases. In particular, the change in the reactance component X (=ωL) is small in the small film thickness region (a) of the conductive film, larger in the intermediate film thickness region (b) of the conductive film, and substantially saturated in the large film thickness region (c) of the conductive film.

Figure 19B:
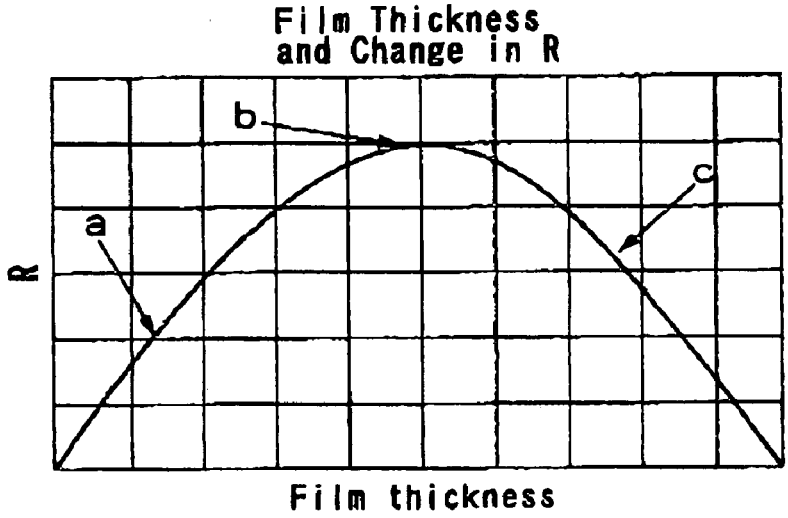
FIG. 19B is a graph showing a change in the resistance component of the synchronous detection output with a change in the thickness of a conductive film.

FIG. 19B shows a change in the resistance component (R) of the synchronous detection output, which appears on the detection terminal side of the sensor coil 210 with a change in the thickness of the conductive film, against the change in the thickness of the conductive film. In the relationship between the change in the film thickness of the conductive film and the change in the resistance component, the resistance component R changes as shown in the Figure as the film thickness decreases. In particular, the resistance component R output greatly changes linearly in the small film thickness region (a), does not change substantially in the intermediate film thickness region (b), and decreases in the large film thickness region (c). In the case of a copper film, the region (a) corresponds to a film thickness around 1000 Å, the region (b) 2000-3000 Å, and the region (c) over 5000 Å.

Figure 19C:
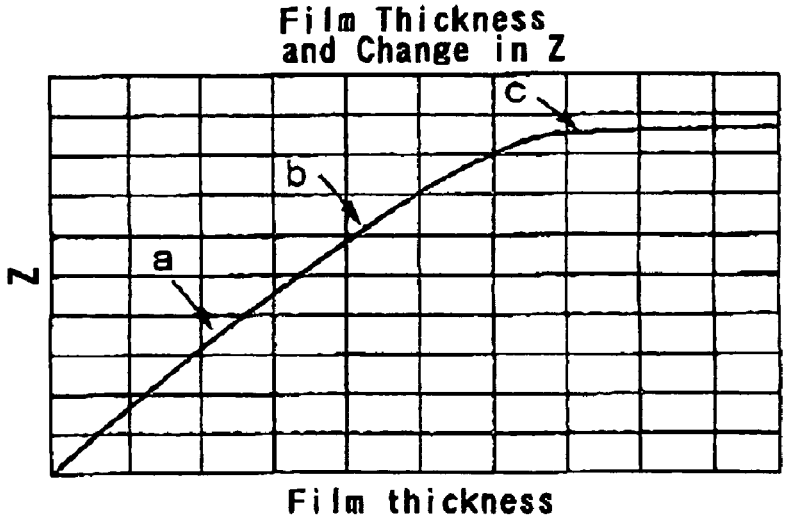
FIG. 19C is a graph showing a change in the impedance (amplitude) of the synchronous detection output with a change in the thickness of a conductive film.

It is possible to output a synthesized impedance Z, corresponding to the thickness of the conductive film, by raising each of the resistance component output and the reactance component output to the second power and calculating the square root of the sum by the vector operation circuit. FIG. 19C shows the relationship between the thickness of the conductive film and the synthesized impedance Z. As apparent from FIG. 19C, the region in the synthesized impedance Z, in which the output changes linearly with a change in the film thickness, expands significantly as compared to the case of solely measuring the resistance component or the reactance component as in FIG. 19A or 19B. Thus, it becomes possible with the synthesized impedance Z to measure the film thickness of a conductive film with a wide dynamic range.

According to the above-described embodiments, electrolytic processing of a processing object, such as a conductive film, is carried out by applying a voltage from the processing power source 58 to between the processing electrodes 50 and the feeding electrodes 52, and the thickness (film thickness) of the processing object, such as a conductive film, is measured with an eddy current sensor during electrolytic processing. Electrolytic processing proceeds when the voltage is being applied between the processing electrodes 50 and the feeding electrodes 52. Accordingly, when the thickness of the processing object is measured during application of a voltage between the processing electrodes 50 and the feeding electrodes 52, the measured thickness can differ from the actual thickness.

As is known, the formation of pits in the processing surface of a workpiece can be effectively suppressed by applying a pulse voltage, whose potential changes periodically, between the processing electrodes 50 and the feeding electrodes 52 in carrying out electrolytic processing. However, when the thickness of a processing object is measured with an eddy current sensor while carrying out electrolytic processing of the processing object by applying a pulse voltage between the processing electrodes 50 and the feeding electrodes 52, noise is likely to be mixed into the detection signal of the eddy current sensor when the frequency of the pulse voltage applied comes close to the frequency (e.g. several tens of MHz) that the sensor generates for detection.

Figure 20:
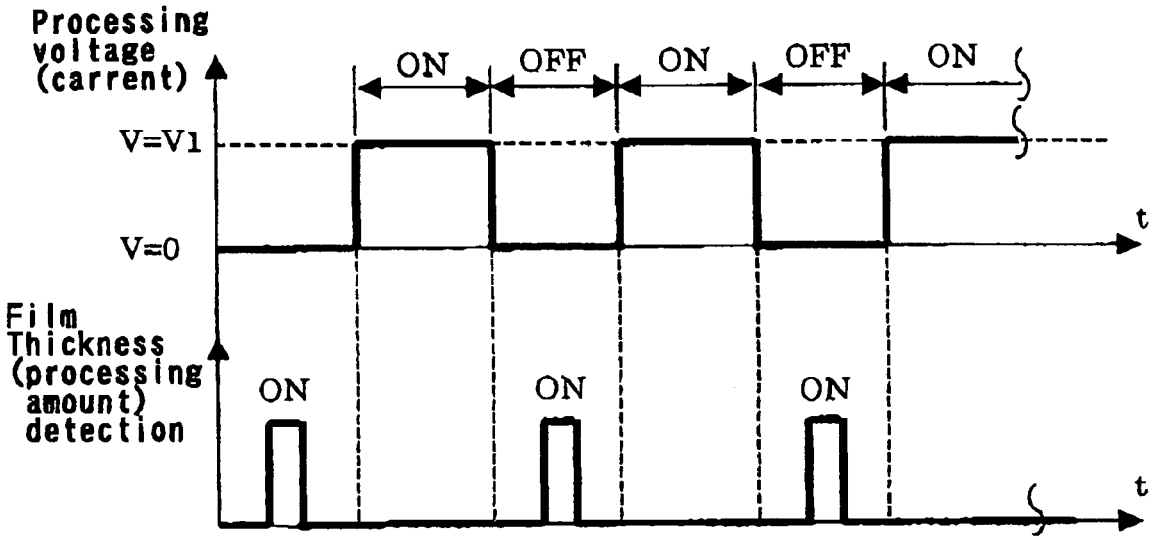
FIG. 20 is a diagram showing the relationship between a pulse voltage, applied between a processing electrode and a feeding electrode, and timing of measurement with an eddy current sensor.

In view of the above, a bipolar power source, which applies a pulse voltage with a periodical repetition of voltage V1 (on) and voltage 0 (off) as shown in FIG. 20, may be used as the processing power source 58 for applying a voltage between the processing electrodes 50 and the feeding electrodes 52, and the thickness of a processing object, such as a conductive film, may be measured with an eddy current sensor by making the sensor on when the pulse voltage is periodically 0, i.e., when no voltage is being applied between the processing electrodes 50 and the feeding electrodes 52.

By thus detecting the thickness (film thickness) of a processing object, such as a conductive film, with an eddy current sensor when no voltage is being applied between the processing electrodes 50 and the feeding electrodes 52, i.e., when the electrolytic processing is not in progress, it becomes possible to perform accurate control of the processing amount. Further, mixing of noise into the detection signal of the eddy current sensor can be reduced even when the frequency of the pulse voltage applied between the processing electrodes 50 and the feeding electrodes 52 comes close to the frequency (e.g. several tens of MHz) that the sensor generates for detection. Furthermore, by making the lowest potential of the pulse voltage 0, the thickness of the processing object can be detected at any time when the voltage is periodically 0 (off).

Instead of using a bipolar power source as a power source for applying a pulse voltage, it is possible to use a different type of power source. For example, it is possible to use a DC power source which periodically turns on and off electricity by timer control or relay control. It is also possible to connect a 50/60 Hz AC power source, which is provided in factories and homes, to a circuit incorporating a diode so as to cut the half-waves of the alternating current. It is also possible to generate a pulse voltage by adding a bias voltage to an AC voltage. It is also possible to use a means for supplying a periodically changing voltage (potential) using a thyristor, a condenser and a diode. Further, it is possible to use a commercially available switching power source. A programmable power source or a sequence control power source, which can perform waveform control, is particularly preferred.

Though in this embodiment a square wave is used for the pulse voltage applied between the processing electrodes 50 and the feeding electrodes 52, a sine curve, a triangular wave, a saw-tooth wave, a step wave, etc. may also be used.

Further, it is also possible to carry out electrolytic processing of a processing object by applying a direct current between the processing electrodes 50 and the feeding electrodes 52, without using a pulse voltage, and to provide a voltage-off time of not applying a direct current between the processing electrodes 50 and the feeding electrodes 52 during electrolytic processing, and measure the thickness of the processing object with an eddy current sensor during the voltage-off time.

As described hereinabove, according to the present invention, the thickness of a processing object is detected with an eddy current sensor, disposed not in contact with a processing electrode and a feeding electrode, from a change in eddy current loss during electrolytic processing of the processing object. This makes it possible to detect the end point of electrolytic processing stably with high precision and with a relative simple construction.

In particular, by detecting the thickness of the processing object with the eddy sensor when a pulse voltage applied between the processing electrode and the feeding electrode with any inputting style is off, it becomes possible to reduce mixing of noise into the detection signal of the sensor and perform accurate control of the processing amount.

Although certain preferred embodiments of the present invention have been shown and described in detail, it should be understood that various changes and modifications may be made therein without departing from the scope of the appended claims.

The invention claimed is:

1. An electrolytic processing method comprising:

providing a processing electrode and a feeding electrode both covered with an ion exchanger;

bringing a processing object close to the processing electrode and the feeding electrode;

supplying ultrapure water, pure water, a liquid having an electric conductivity of not more than 500 μS/cm or an electrolytic solution between the processing object and the processing electrode, and between the processing object and the feeding electrode;

applying a voltage between the processing electrode and the processing object via the feeding electrode while moving the processing object and the processing electrode relative to each other, and while moving the processing object and the feeding electrode relative to each other; and detecting a thickness of the processing object from a change in eddy current loss by an eddy current sensor surrounded by an insulator and located in the feeding electrode.

2. The electrolytic processing method according to claim 1, wherein the eddy current sensor comprises a sensor coil for generating an eddy current in the processing object, and an oscillation circuit, connected to the sensor coil, for generating a variable frequency signal in response to the eddy current loss, the sensor coil and the oscillation circuit being constructed integrally.

3. The electrolytic processing method according to claim 1, wherein the eddy current sensor comprises a sensor coil disposed in the vicinity of the processing object, a signal source for supplying an alternating-current signal to the sensor coil so as to generate an eddy current in the processing object, and a detection circuit for detecting the eddy current generated in the processing object by means of the sensor coil.

4. The electrolytic processing method according to claim 1, wherein the thickness of the processing object is detected when the voltage applied between the processing electrode and the processing object via the feeding electrode with any inputting style is off.

5. The electrolytic processing method according to claim 4, wherein the voltage applied between the processing electrode and the processing object via the feeding electrode is a pulse voltage whose lowest potential periodically becomes 0.

6. The electrolytic processing method according to claim 1, wherein said detecting the thickness of the processing object comprises:

generating an eddy current in the processing object using a sensor coil of the eddy current sensor for determining the eddy current loss; and generating a variable frequency signal in response to the eddy current loss using an oscillation circuit of the eddy current sensor.

7. The electrolytic processing method according to claim 1, wherein said detecting the thickness of the processing object comprises:

supplying an alternating-current signal to a sensor coil of the eddy current sensor so as to generate an eddy current in the processing object, the sensor coil being disposed in the vicinity of the processing object; and detecting the eddy current generated in the processing object by the sensor coil.

* * * * *